US005339874A

United States Patent [19]

Cragun

[11] Patent Number: 5,339,874

[45] Date of Patent: Aug. 23, 1994

[54] BEVERAGE DISPENSING APPARATUS AND PROCESS

[75] Inventor: E. Brent Cragun, Mountain Green, Utah

[73] Assignee: Fountain Fresh International, Salt Lake City, Utah

[21] Appl. No.: 919,404

[22] Filed: Jul. 23, 1992

[51] Int. Cl.[5] ..... B65B 3/04

[52] U.S. Cl. ..... 141/9; 141/39; 141/48; 141/6; 141/95; 141/104; 141/105; 141/91; 141/160; 141/198

[58] Field of Search ..... 141/1, 9, 104, 105, 141/94–97, 46, 140–141, 159, 160, 157, 198, 39, 40, 6, 48, 91

[56] References Cited

U.S. PATENT DOCUMENTS

| | | | |
|---|---|---|---|
| D. 271,462 | 11/1983 | Lents | D7/305 |
| D. 287,688 | 1/1987 | Mortimer | D7/307 |
| D. 287,689 | 1/1987 | Mortimer | D7/307 |
| D. 288,516 | 3/1987 | Mortimer | D7/307 |
| D. 294,105 | 2/1988 | Mathews | D7/307 |
| 755,600 | 3/1904 | Carlson . | |
| 926,550 | 6/1909 | Dafoe . | |
| 991,664 | 5/1911 | Strasburger . | |
| 1,442,405 | 1/1923 | Hawthorne . | |
| 1,521,928 | 1/1925 | Campbell . | |
| 1,661,602 | 3/1928 | Dary . | |
| 1,765,557 | 6/1930 | Wright . | |
| 1,795,763 | 3/1931 | Cramer et al. . | |
| 1,883,787 | 10/1932 | Head et al. . | |
| 2,065,466 | 12/1936 | Horn | 141/7 |
| 2,110,840 | 3/1938 | Kann | 225/1 |
| 2,140,589 | 12/1938 | Lannmark | 198/131 |
| 2,154,677 | 4/1939 | Hartman | 225/21 |
| 2,175,682 | 10/1939 | Chaffee | 226/68 |
| 2,261,338 | 11/1941 | Carlson | 225/21 |
| 2,321,844 | 6/1943 | Nicholson | 225/21 |
| 2,401,914 | 6/1946 | Di Pietro | 225/26 |
| 2,427,429 | 9/1947 | Waite et al. | 225/21 |
| 2,462,019 | 2/1949 | Bowman | 225/26 |
| 2,558,522 | 6/1951 | Knapp | 225/21 |
| 2,653,733 | 9/1953 | Rudd et al. | 222/145 |
| 2,655,929 | 10/1953 | Herold | 134/131 |
| 2,674,263 | 4/1954 | Rupp et al. | 137/604 |
| 2,698,703 | 1/1955 | Harvey | 222/207 |
| 2,763,994 | 9/1956 | Chandler | 62/7 |
| 2,770,394 | 11/1956 | Mueller | 222/1 |
| 2,776,074 | 1/1957 | St. Laurence | 222/2 |
| 2,788,027 | 4/1957 | Ullman et al. | 141/1 |
| 2,834,190 | 5/1958 | Andrews et al. | 62/7 |
| 2,838,077 | 6/1958 | Cooper | 141/82 |
| 2,961,127 | 11/1960 | Reynolds et al. | 222/70 |
| 3,011,681 | 12/1961 | Kromer | 222/1 |
| 3,021,685 | 2/1962 | Gore et al. | 62/39 |

(List continued on next page.)

FOREIGN PATENT DOCUMENTS

| | | | |
|---|---|---|---|
| 2336754 | 2/1974 | Fed. Rep. of Germany | 222/129.1 |
| 487986 | 3/1992 | Japan | 141/198 |
| 2098588 | 11/1982 | United Kingdom | 141/198 |

*Primary Examiner*—Ernest G. Cusick
*Attorney, Agent, or Firm*—Madson & Metcalf

[57] ABSTRACT

A novel beverage dispensing apparatus and process for use by a consumer in a grocery store to fill recyclable containers with beverages, such as soft drinks. The apparatus includes a retraction assembly which comprises a yoke configured to engage a bottle for retracting the neck of the bottle into a dispensing chamber where the opening of the bottle is sealed in fluid communication with a beverage dispensing nozzle. The beverage dispensing nozzle is configured with three ports—a syrup port, a carbonated water port and a relief port. Through the syrup port, a syrup may be introduced into the center of the bottle. The carbonated water port is configured such carbonated water may be directed through onto a side wall of the bottle. The relief port is positioned concentrically about the syrup port and between the syrup port and the carbonated water port and provides a port through which the fluid being displaced by the beverage entering the container may exit the container. A liquid detector is located in fluid communication with the relief port and monitors the flow of fluid being displaced by the beverage entering the bottle to thereby determine when the bottle is full of beverage.

31 Claims, 9 Drawing Sheets

U.S. PATENT DOCUMENTS

| | | | |
|---|---|---|---|
| 3,034,685 | 5/1962 | Breitenstein | 222/132 |
| 3,058,620 | 10/1962 | Kromer | 222/1 |
| 3,090,293 | 5/1963 | Plock et al. | 99/275 |
| 3,120,326 | 2/1964 | Hedeman | 222/144.5 |
| 3,122,151 | 2/1964 | Chambers | 134/99 |
| 3,162,323 | 12/1964 | Kromer | 222/1 |
| 3,185,348 | 5/1965 | Pollak et al. | 222/95 |
| 3,193,143 | 7/1965 | Maieli | 222/42 |
| 3,200,997 | 8/1965 | Creswick | 222/145 |
| 3,206,069 | 9/1965 | Jacobs et al. | 222/1 |
| 3,208,639 | 9/1965 | Marwell et al. | 222/82 |
| 3,209,952 | 10/1965 | Cornelius | 222/129.1 |
| 3,215,312 | 11/1965 | Guzzi | 222/129.1 |
| 3,224,641 | 12/1965 | Morgan | 222/129.1 |
| 3,240,395 | 3/1966 | Carver | 222/129.1 |
| 3,259,273 | 7/1966 | Kromer | 222/1 |
| 3,263,864 | 8/1966 | Welty et al. | 222/129 |
| 3,289,948 | 12/1966 | Fuerst | 239/406 |
| 3,418,069 | 12/1968 | Decupper | 21/74 |
| 3,460,593 | 8/1969 | Niehaus et al. | 141/372 |
| 3,503,541 | 3/1970 | Jacobs et al. | 222/129.1 |
| 3,583,601 | 6/1971 | Ayers | 222/1 |
| 3,587,597 | 6/1971 | Courtney et al. | 134/95 |
| 3,599,833 | 8/1971 | Reichenberger | 222/23 |
| 3,604,480 | 9/1971 | Reichert | 141/39 |
| 3,638,392 | 2/1972 | Welker, Jr. et al. | 53/123 |
| 3,727,844 | 4/1973 | Bencic | 239/414 |
| 3,856,059 | 12/1974 | Hartness et al. | 141/165 |
| 3,863,810 | 2/1975 | Hanson | 222/129.1 |
| 3,876,107 | 4/1975 | Meindl et al. | 222/64 |
| 3,893,493 | 7/1975 | Fuerst et al. | 141/95 |
| 3,904,079 | 9/1975 | Kross | 222/2 |
| 3,908,404 | 9/1975 | Cox | 141/46 |
| 3,934,759 | 1/1976 | Giannella et al. | 222/129.1 |
| 3,940,019 | 2/1976 | Kross et al. | 222/30 |
| 3,949,902 | 4/1976 | Thompson | 222/129 |
| 3,986,537 | 10/1976 | Wilhere | 141/198 |
| 4,164,964 | 8/1979 | Daniels | 141/329 |
| 4,171,069 | 10/1979 | Cornelius et al. | 222/1 |
| 4,174,049 | 11/1979 | Bolen | 222/5 |
| 4,191,183 | 3/1980 | Mendelson | 128/214 |
| 4,254,804 | 3/1981 | Wada et al. | 141/40 |
| 4,271,877 | 6/1981 | Whitaker et al. | 141/166 |
| 4,271,987 | 6/1981 | Eriksson et al. | 222/160 |
| 4,304,741 | 12/1981 | Avison et al. | 261/121 |
| 4,305,527 | 12/1981 | McMillin et al. | 222/1 |
| 4,317,475 | 3/1982 | Miler et al. | 141/95 |
| 4,333,587 | 6/1982 | Fessler et al. | 222/129 |
| 4,342,710 | 8/1982 | Adolfsson et al. | 261/121 |
| 4,469,150 | 9/1984 | Grimaldi | 141/95 |
| 4,484,697 | 11/1984 | Fry, Jr. | 222/95 |
| 4,494,583 | 1/1985 | Reeves, Jr. et al. | 141/83 |
| 4,498,508 | 2/1985 | Scholle et al. | 141/5 |
| 4,530,202 | 7/1985 | Powell et al. | 53/426 |
| 4,534,494 | 8/1985 | Hautemont | 141/91 X |
| 4,567,926 | 2/1986 | Lichfield et al. | 141/332 |
| 4,574,850 | 3/1986 | Davis | 141/9 |
| 4,590,974 | 5/1986 | Mathews | 141/1 |
| 4,687,120 | 8/1987 | McMillin | 222/1 |
| 4,708,153 | 11/1987 | Hambleton et al. | 134/170 |
| 4,747,516 | 5/1988 | Baker | 222/129.1 |
| 4,753,277 | 6/1988 | Holcomb et al. | 141/95 |
| 4,787,427 | 11/1988 | Bacroix et al. | 141/39 |
| 4,793,518 | 12/1988 | Burton | 222/129 |
| 4,795,061 | 1/1989 | Peckjian | 222/66 |
| 4,804,118 | 2/1989 | Mullen et al. | 222/641 |
| 4,832,093 | 5/1989 | Morrone | 141/40 |
| 4,901,887 | 2/1990 | Burton | 222/131 |
| 4,911,212 | 3/1990 | Burton | 141/369 |
| 4,940,212 | 7/1990 | Burton | 261/64 |
| 4,972,883 | 11/1990 | Hassell et al. | 141/1 |
| 4,976,295 | 12/1990 | Clusserath | 141/39 |
| 4,982,877 | 1/1991 | Burton | 222/321 |
| 4,984,717 | 1/1991 | Burton | 222/183 |
| 5,096,095 | 3/1992 | Burton | 222/173 |

BEVERAGE DISPENSING APPARATUS AND PROCESS

BACKGROUND

1. The Field of the Invention

The present invention is related to an improved beverage dispensing apparatus and process. More particularly, the present invention is related to an improved soft drink mixing and dispensing apparatus which can be employed in a conventional grocery store for use by a consumer to fill recyclable bottles.

2. Technical Background

Soft drinks and related products have recently achieved a high degree of popularity. Indeed, the sale of soft drinks and related products has resulted in a multi-billion dollar a year market in the United States. Some soft-drink products have achieved popularity virtually throughout the entire world. However, one of the problems with the sales and marketing of soft drinks is that they continue to be relatively expensive. Consumer demand would likely expand if the cost of soft drinks and their related products could be kept lower.

Some of the reasons for the high cost of soft drinks are unrelated to the actual cost of the ingredients to make the drink. For example, soft drink containers are relatively expensive when compared with the cost of the finished product. Expensive metal cans or plastic containers are presently widely used to dispense soft drinks. At the same time, the price of metal, such as aluminum, is high. Plastic soft drink containers are also expensive when compared to the cost of the actual soft drink contained within the container. While some soft drink containers are recyclable, notably aluminum cans, most soft drink containers are not recycled in practice. For example, it is unusual to recycle plastic bottles.

A further factor resulting in increased cost of soft drinks is expensive bottling techniques. While soft drink bottling is highly automated, the cost of the automated equipment is high. At the same time, significant labor is involved in both soft drink bottling and the distribution of the filled bottles. Thus, labor and equipment costs add significantly to the cost of the soft drink.

As a result of the factors discussed above, the actual soft drink purchased in a grocery store or other retail outlet may represent a relatively minor portion of the cost of the finished product. A significant portion of the cost is represented by the cost of the soft drink container and the labor and equipment costs in manufacturing the drink, filling the containers and distributing the filled containers.

Thus, it would be an economic advantage to the consumer, the manufacturer and the retail outlet alike to reduce the costs of these items which tend to increase the cost of the finished soft drink product. Reduction in the cost of these items would likely increase the volume of soft drink sold by the retail outlet, resulting in increased profits for both the retailer and the manufacturer. Additionally, the lower costs would be an obvious benefit to the consumer.

Two ways that cost could be controlled would be through the reuse of reusable containers and through reducing the cost of equipment and labor required in filling those containers. Specifically, it would be beneficial to provide the consumer with a reusable container which the consumer could himself refill at the retail outlet.

In the past, however, it has been difficult to provide the necessary equipment for refilling containers at a retail outlet. This is particularly true in the case of goods such as soft drinks that require the mixing of two or more components for the formation of the final product.

One of the major limitations on such equipment is that of size. Square footage within a retail outlet is at a premium. Consequently, equipment and display cases utilized within a retail must be of optimum size. The use of conventional equipment having the capability of dispensing a large volume of soft drinks is generally not viable in a grocery store setting because of space constraints.

An additional problem arises when it is necessary to mix various components of the product dispensed. For example, when bottling soft drinks it is typically necessary to mix carbonated water with a syrup flavoring. Thus, there must exist a source for each component, and each component must be properly pumped, treated and mixed. This presents complex problems when attempting to employ technology which may be used within a dispensing machine to be installed within a conventional grocery store space.

An additional problem associated with beverage dispensing machines designed for use directly by the consumer is that the quality of the final product is generally not consistent. The proportion of carbonated water and syrup flavoring in the beverage, or Brix, may depend on pressures and temperatures within the machine which may vary greatly over time. Also, because carbonated water degenerates rapidly, the level of carbonation in the carbonated water may vary substantially depending on how the machine is used. Additionally, the temperature at which the beverage is dispensed may be greatly affected by a variety of factors, including the ambient temperature and how long the machine has been sitting without being used.

Contaminants affecting the quality of the beverage may be introduced into the beverage because of the difficulty of keeping the machine clean. Additionally, if the container is supplied by the consumer, it is difficult to exercise any degree of control over how clean the container will be.

A significant problem associated with the use of consumer-operated beverage dispensing machines is that such machines are typically not very user friendly. Depending on the machine used, a significant degree of know-how may be required of the consumer to successfully operate the machine. For example, such machines may rely on the consumer for a variety of monitoring functions, such as judging when the container is full and controlling the effects of foaming.

A typical consumer-operated beverage dispensing machine includes a switch, within the control of the consumer, for commencing and discontinuing flow of the beverage. Permitting the consumer to commence and discontinue flow of the beverage, however, is inefficient because of the potential for spillage. Of course, beverage which is spilled adds to the overhead costs of operating the machine.

Relying on the consumer to control foaming can also result in spillage of beverage. Indeed, controlling foaming of carbonated beverages in such machines is a substantial problem. Foaming in the beverage makes it difficult for the consumer to fill the container with any rapidity. Additionally, if foam spills over the top of the container and onto the container's exterior, the consumer must then wash off the exterior of the container, resulting in a general disincentive for the consumer to use the machine.

Thus, it would be an advancement in the art to provide a beverage dispensing apparatus and process which may be used by a consumer to fill recyclable containers with beverages such as carbonated soft drinks and thereby provide a low-cost alternative to purchasing pre-packaged beverages.

It would be a further advancement in the art to provide such a beverage dispensing apparatus and process which would consistently dispense a quality beverage, such as a beverage having a consistent Brix, having highly carbonated water and being dispensed at a consistently cold temperature.

It would be an additional advancement in the art to provide such a beverage dispensing apparatus and process which would be user friendly, and which would not rely on the user to determine when to shut off the flow of beverage to the container or to control foaming.

Such a device and process is disclosed and claimed herein.

BRIEF SUMMARY AND OBJECTS OF THE INVENTION

The present invention is directed to a novel beverage dispensing apparatus and process for use by a consumer in a grocery store or other retail outlet. The apparatus may be used by the consumer to fill recyclable containers with beverages, such as soft drinks, and purchase the beverages at a substantially lower cost than pre-bottled drinks.

The apparatus of the present invention includes a bottle and cap rinsing station for use by the consumer in rinsing a bottle and cap prior to filling the bottle with a beverage. The bottle rinsing station includes a bottle rinsing housing upon which the bottle may be rested in an inverted position. A bottle rinsing nozzle is disposed within the bottle rinsing housing such that it is positioned within the interior of the bottle when the bottle is positioned on the bottle rinsing housing.

The cap rinsing station includes a cap rinsing housing configured to receive a bottle cap. Within the cap rinsing housing is disposed a nozzle through which water may be directed onto the interior of the cap.

After placing a bottle and cap in their appropriate positions on the rinsing station, the consumer may press a button to commence the rinsing process. After the button is pressed, a flow of hot water is directed through the rinsing nozzle disposed within the bottle, thereby spraying water onto the interior walls of the bottle. The water is sprayed into the bottle with sufficient force that substantially the entirety of the interior of the bottle is rinsed with the water.

Simultaneously, a flow of hot water is directed through the cap rinsing nozzle and onto the interior of the cap. Thus, the cap and bottle are simultaneously rinsed with hot water for a predetermined period of time. Following the rinsing cycle with hot water, a flow of cold water is directed through the rinsing station in a similar manner as was the hot water. The cold water assists in removing any heat the bottle and cap may have retained as a result of the hot-water rinse.

To prevent the user from inadvertently removing the bottle during the rinsing process and being sprayed with the rinse water, a mercury switch is positioned at the base of the bottle rinsing housing. The mercury switch is configured such that it is actuated when a bottle is properly positioned on the bottle rinsing housing. Thus, removal of the bottle from this position causes the switch to be actuated, thereby sending signal to immediately discontinue the flow of water through the rinsing station.

The apparatus of the present invention also includes a retraction assembly which comprises a yoke configured to engage a beverage container, such as any of a number of plastic, recyclable bottles which are conventionally known for use in the bottling of soft drinks. The yoke is attached to retraction shafts which are moved in a generally vertical direction by a retraction ram.

The retraction assembly is configured such that after engaging the neck of a bottle, the retraction assembly will retract the neck of the bottle into a dispensing chamber where the opening of the bottle is sealed in fluid communication with a beverage dispensing nozzle.

An infrared light emitter and detector are located on the yoke to verify whether an object has been placed on the yoke and whether that object is a bottle. When a glass or plastic bottle is placed on the yoke, the beam of IR light across the yoke will be attenuated a substantial amount, but not completely. Thus, by measuring the amount of attenuation of the beam of IR light across the yoke, it is assumed that if the beam is attenuated a substantial amount, but not completely, the object resting in the yoke is a bottle. If, however, a user inadvertently places a finger or other generally opaque object in the yoke, the beam will be virtually completely attenuated, and the retraction ram will not retract.

The present invention is preferably configured with a pressure sensor, such as pressure sensitive tape, positioned about the periphery of the opening to the dispensing chamber. Thus, if any article, such as the user's hand, tends to interfere with the retraction of the bottle into the dispensing chamber, it will engage the pressure sensitive tape, thereby sending a signal causing the retraction of the bottle to discontinue. The bottle will then be lowered, permitting the obstruction to be removed by the user.

A magnetic switch is provided on one of the retraction shafts to ensure that the bottle placed on the yoke for filling does not have a cap on it. If a cap is on the bottle, when the bottle is retracted into the dispensing chamber, the cap will interfere with the dispensing nozzle, thereby impeding further retraction of the yoke and not permitting the bottle to be retracted to the fill position.

The magnetic switch is positioned relative to the retraction shaft such that it will be actuated only when the yoke retracts to the fill position. Hence if the cap is left on the bottle thereby preventing the bottle from retracting to the fill position, the magnetic switch will not be actuated. If the magnetic switch is not actuated upon retraction of the bottle into the dispensing chamber, the bottle is lowered and the user is provided with an instruction to remove the cap from the bottle and again place the bottle on the yoke.

The retraction ram is an air-driven ram. Advantageously, the ram is driven by pressurized carbon dioxide gas ($CO_2$), such as that used for carbonating the water dispensed by the apparatus. Thus, the present invention avoids utilizing an external source of energy to drive the retraction ram by taking advantage of the existing supply of pressurized $CO_2$.

The beverage dispensing nozzle is configured with three ports—a syrup port, a carbonated water port and a relief port. Through the syrup port, located in the center of the beverage dispensing nozzle, a component of the beverage such as a syrup or other flavoring may be introduced into the center of the bottle.

The carbonated water port of the beverage dispensing nozzle is configured as a cylindrically shaped channel extending concentrically about the syrup port. The carbonated water port is further configured such that a non-foamable component of the beverage, such as carbonated water, may be introduced into the bottle by directing it through the carbonated water port and onto a side wall of the bottle.

The third port, or relief port, is positioned in the beverage dispensing nozzle concentrically about the syrup port and between the syrup port and the carbonated water port. The relief port provides a port through which the fluid being displaced by the beverage entering the container may exit the container.

Thus, when using the apparatus of the present invention to fill a bottle with a beverage, the carbonated water is introduced into the bottle by directing it along the sides of the bottle. This helps to substantially reduce the amount of foaming which occurs. With the introduction of carbonated water into the bottle, a flavoring component of the beverage, such as a syrup flavoring, is simultaneously introduced into the bottle down the center of the bottle. Thus, the syrup does not mix with the carbonated water until after both beverage components have been separately introduced into the bottle, thereby keeping the amount of foam generated by the carbonated water to a minimum.

The apparatus of the present invention further includes a liquid detector which is located in fluid communication with the relief port of the beverage dispensing nozzle. The liquid detector monitors the flow of fluid being displaced by the beverage entering the bottle to thereby determine when the bottle is full of beverage. Thus, after sensing liquid in the flow of fluid exiting the bottle through the relief port, the flow of beverage into the bottle is discontinued.

In a preferred embodiment, a pressure switch is employed as the liquid detector. The pressure switch is exposed to the pressure in a pressure sensing chamber connected to the relief port of the beverage dispensing nozzle. Thus, as the bottle is initially filled with beverage, the fluid being displaced by the beverage is air and the pressure switch will sense a substantially constant pressure within the pressure sensing chamber. As the level of beverage in the bottle approaches the top of the bottle, some liquid—generally foam in the case of a soft drink—will be forced through the relief port and into the pressure sensing chamber. The liquid within the foam causes a sudden jump in the pressure within the pressure sensing chamber, thereby actuating the pressure switch. In response to the detection of liquid by the pressure switch, a signal is sent discontinuing the flow of beverage into the bottle.

In a presently preferred embodiment of the invention, the flow of beverage into the bottle is commenced again following a short wait state, during which any foam which has been generated within the bottle is permitted to dissipate. Following the wait state, additional beverage is added to the bottle, thereby ensuring that the bottle is filled to the "full" level. As the additional beverage is added to the bottle, the fluid being displaced from the bottle is again monitored for the presence of liquid. Once liquid is again detected by the pressure switch, the flow of fluid into the bottle is discontinued.

Upon the completion of this topping process, the yoke lowers the filled bottle out of the filling chamber. The bottle may then be removed from the yoke by the consumer and a cap may be screwed onto the bottle.

After the apparatus has been utilized to dispense a beverage into a bottle, it goes through a sanitizing process to clean the apparatus and eliminate any bacterial buildup. During the sanitizing process, the yoke retracts into the dispensing chamber and the opening of the chamber is closed by a chamber door which is slid over the opening.

In a preferred embodiment, two ultra-violet lights are positioned inside the dispensing chamber. During the sanitizing process, these lights are turned on for a predetermined period of time. The exposure of the interior of the dispensing chamber to ultra-violet light exposes any bacteria within the chamber to the light and aids in destroying the bacteria.

Additionally, spray nozzles are positioned in each of the side walls of the dispensing chamber. During the sanitizing process, hot water is sprayed through these nozzles to clean the retract shafts, yoke, dispensing nozzle and other objects within the interior of the chamber. A drain in the bottom of the chamber accommodates drainage of the water sprayed within the chamber during the sanitizing process.

Following the sanitizing process, the chamber door stays closed and the yoke remains fully retracted. The apparatus maintains this "rest state" until it receives another command from the user. Upon receiving an appropriate command from a user, the chamber door will open and the yoke will be extended to permit the user to fill another bottle. Advantageously, the chamber door is configured with a raised edge such that any water which accumulates on the door during the sanitizing process will not fall out of the opening of the chamber as the door is opened.

The present invention preferably utilizes a proportioning pump, such as that disclosed and claimed in U.S. Pat. No. 5,058,768 to Lichfield and owned by the same assignee as herein, which patent is incorporated herein by this reference. The proportioning pump of the Lichfield patent enables precise ratios of carbonated water and flavoring syrup to be dispensed, thereby enabling a beverage with a consistent Brix to be dispensed by the apparatus of the present invention.

A proportioning pump is provided for each flavor of beverage to be dispensed in the apparatus. In a presently preferred embodiment, six flavors are dispensed at each beverage dispensing station. The flavoring syrup is preferably provided in a bag-in-box container, such as those conventionally employed in the beverage dispensing industry.

A supply of cold, carbonated water is provided for each proportioning pump. The carbonated water acts as the drive fluid for the pump. A line connecting the corresponding flavoring syrup to each pump is also provided. Additionally, a second line connecting a sweetener, such as aspartame, to the pump may also be provided, as required by the particular beverage to be dispensed.

Advantageously, the present invention includes a postpump water manifold into which the outlet water lines from the proportioning pumps are merged into a single line. The single water line from the post-pump water manifold then passes through a cooling coil immersed in an ice-water bath before connecting into a dispensing head.

Although the carbonated water has been cooled prior to entering the proportioning pumps, this post-pump cooling provides additional cooling immediately prior to dispensing. Because the apparatus may sit idle for extending periods of time between dispensing cycles, the water within the water lines may gain a substantial amount of heat during that time. Thus, passing the water through a post-pump cooling coil prior to dispensing ensures that the temperature of the dispensed beverage is consistently cold.

Employing the post-pump manifold enables all of the water being pumped out of each proportioning pump to be cooled in the post-pump cooling cycle by utilizing only a single cooling coil. Without the post-pump manifold, a separate cooling coil would need to be employed for the outlet water line of each proportioning pump.

The apparatus of the present invention also includes a head manifold into which the syrup lines coming out of the proportioning pumps are connected. Within the head manifold, the syrup lines are merged into a common syrup chamber which leads to the syrup port of the beverage dispensing nozzle. A solenoid valve is provided on each syrup line for opening the line and permitting syrup to flow through the line and into the head manifold for dispensing into a bottle. A one-way valve is provided at the point of connection of each syrup line into the common syrup chamber, thereby ensuring that no reverse flow through the individual syrup lines from the common syrup chamber will occur.

A water line is connected into the common syrup chamber at its distal end. Thus, after dispensing a flavor of syrup through the common line, the common syrup chamber may be flushed during a sanitizing process by running hot water through the line.

The present invention also employs a unique carbonator which maximizes the quality of the carbonated water to be dispensed. A recirculation line is provided on the carbonator by which water in the carbonator is removed from the carbonator and pumped back into the carbonator through an atomizer, thereby further carbonating the water. By recirculating the carbonated water through the carbonator, the degree of carbonation of the water is maximized.

Thus, it is an object of the present invention to provide a beverage dispensing apparatus and process which may be used by a consumer to fill recyclable containers with beverages such as carbonated soft drinks and thereby provide a low-cost alternative to purchasing pre-packaged beverages.

It is a further object of the present invention to provide such a beverage dispensing apparatus and process which consistently dispenses a quality beverage, such as a beverage having a consistent Brix, having highly carbonated water and being dispensed at a consistently cold temperature.

It is an additional object of the present invention to provide a beverage dispensing apparatus and process which is user friendly, and which does not rely on the user to determine when to shut off the flow of beverage into the container or to control foaming.

These and other objects and advantages of the present invention will become more fully apparent by examination of the following description of the preferred embodiments and the accompanying drawings.

DETAILED DESCRIPTION OF THE PREFERRED EMBODIMENTS

Figure 1:
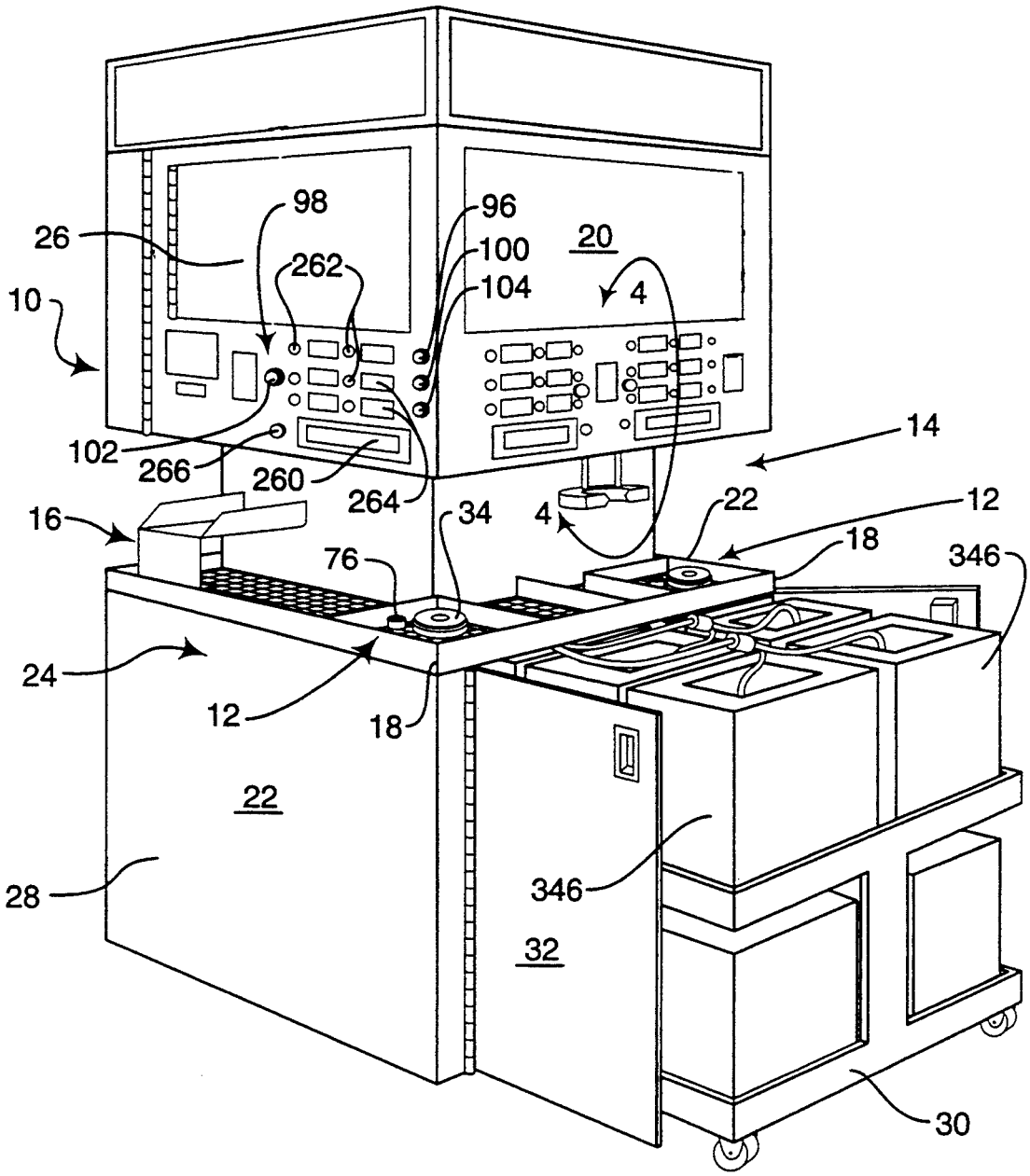
FIG. 1 is a perspective view of the beverage dispensing apparatus of the present invention.

Reference is now made to the figures wherein like parts are referred to by like numerals throughout. With particular reference to FIG. 1, a beverage dispensing apparatus according to the present invention is generally designated at 10. The apparatus 10 is preferably configured to be positioned at the end of an aisle in a grocery store or other retail outlet.

The apparatus 10 includes a bottle and cap rinsing station 12 and a beverage dispensing station 14. The apparatus 10 may also include a fresh-water fill station 16, at which filtered or other purified forms of water may be presented to the consumer.

In a presently preferred embodiment of the invention, the apparatus 10 includes a bottle and cap rinsing station 12 positioned at each of the front corners 18 of the apparatus 10. Additionally, four beverage dispensing stations 14 are preferably included in the apparatus 10, with two beverage dispensing stations 14 positioned on the front 20 of the apparatus and one beverage dispensing station 14 located along each side 22 of the apparatus, as illustrated in FIG. 1.

Of course, the apparatus of the present invention may include a variety of combinations of beverage dispensing stations 14 and bottle and cap rinsing stations 12. The present configuration, as illustrated in FIG. 1, has been found preferable for use at the end of an aisle in a grocery store or other retail outlet.

The apparatus 10 further includes a cabinet 24 which includes an upper section 26 for housing many of the devices which prepare the beverage for dispensing at the beverage dispensing station 14. The cabinet 24 further includes a lower section 28 for housing the containers of beverage flavoring.

When utilizing the present invention to dispense soft drinks, the syrup flavoring for the various flavors of beverage to be dispensed in the machine are preferably stored on a cart 30 which is placed within the lower section 28 of the cabinet 24 through a hingedly mounted door 32. The flavoring syrup may include any of those flavoring syrups conventionally known in the art of beverage dispensing, and preferably is packaged in a bag-in-box container, such as those which are generally commercially available.

A central processing unit (not shown), or CPU, is included within cabinet 24, preferably within the upper section 26 of the cabinet 24. The CPU monitors instructions and other actions of the consumer, instructs the consumer how to proceed, informs the consumer of the status of the beverage dispensing machine at various times and alerts the consumer to abnormal conditions.

The present embodiment employs a Motorola 68705 microprocessor as its CPU, but it will be readily apparent to those of ordinary skill in the art that embodiments based on other microprocessors may also be utilized. The interaction of the CPU with the sensors and actuators utilized in the control system of the present invention is described in detail below.

Figure 2:
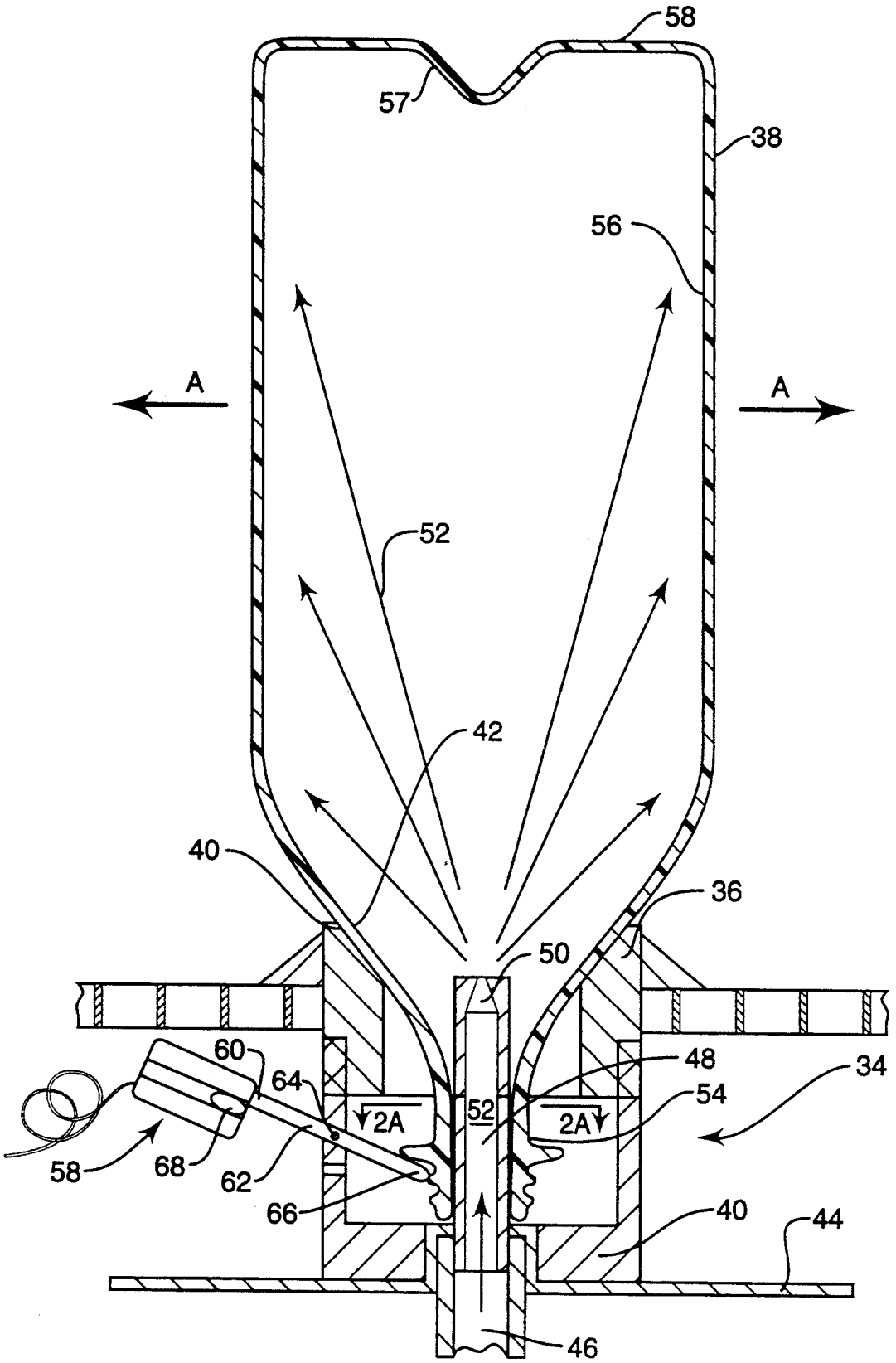
FIG. 2 is a cross-sectional view of the bottle rinsing apparatus of the present invention, illustrated while being used to rinse a bottle in accordance with the process of the present invention.
Figure 2A:
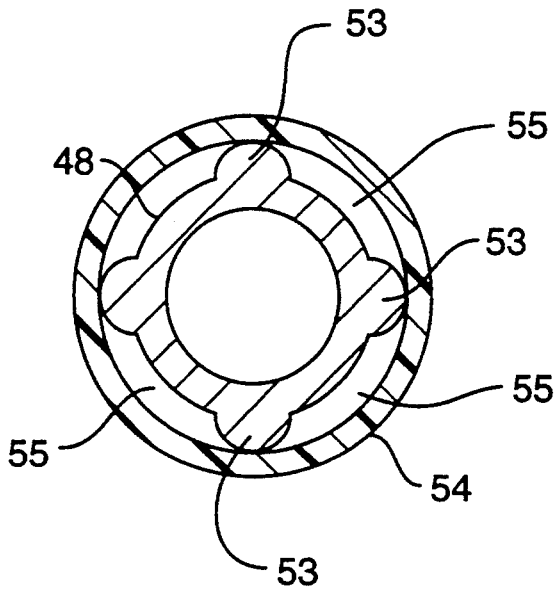
FIG. 2A is a cross-sectional view taken along line *2a—2a* of FIG. 2.

The bottle and cap rinsing station includes a bottle rinsing apparatus 34, as is more particularly illustrated in cross section in FIG. 2. The bottle rinsing apparatus 34 includes a bottle rinsing housing 36 upon which a conventional beverage bottle 38 may be placed for rinsing. The interior portion of the upper walls 40 of the bottle rinsing housing 36 is configured at an angle to accommodate the shoulder portion 42 of the beverage bottle 38.

The described embodiment of the present invention is designed for use with a plastic beverage bottle having either a one liter or two liter capacity, such as those plastic beverage bottles which are generally commercially utilized in the soft drink industry. Such plastic bottles are readily available and are easily recycled. Of course, one of skill in the art will appreciate that the present invention may be readily adapted for use with a variety of bottle designs and with bottles made of a variety of materials.

In the illustrated embodiment of the invention, the bottle rinsing housing 36 is configured to engage a base 44 in mating connection. In the center of base 44 is disposed a water line 46 which is connected to a bottle rinsing nozzle 48. The end of the bottle rinsing nozzle 48 is configured with a port 50 through which rinse water 52 may be sprayed into the bottle 38.

The bottle rinsing nozzle 48 is configured to fit within the opening of bottle 38 and extend beyond the neck 54 such that the port 50 is at least as high as the beginning of the shoulder portion 42 of the bottle 38. If the port 50 is not beyond the neck 54 of the bottle 38, the water 52 used to rinse the bottle 38 may flood the port 50 and inhibit the spray of water 52 into the bottle 38.

The port 50 may flood because as the water 52 drains out of the bottle 38 in the space between the neck 54 and the nozzle 48, some water 52 may tend to accumulate in that space. Hence, by positioning the port 50 above the neck 54 of the bottle 38, a sufficient volume in the space between the neck 54 and the nozzle 48 and beneath the port 50 is provided to allow for some accumulation of water 52 in the neck 54 of the bottle 38 without flooding the port 50.

The port 50 is preferably configured as an inverted cone. Thus, as the water 52 is directed through the nozzle 48 under the force of back pressure in the water line 46, the water 52 will spray out of the port 50 in a generally conical shape. As illustrated in FIG. 2, the water 52 preferably sprays against virtually the entire length of the interior walls 56 of the bottle 38.

A portion of the water sprayed against the interior walls 56 of the bottle 38 will have sufficient momentum that it will travel upwardly along the walls of the bottle 38 and rinse the interior of the bottom 57 of the bottle 38. At the same time, some of the water sprayed onto the interior walls 56 of the bottle 38 will flow down the interior walls 56 of the bottle and thereby rinse the interior portion of the shoulders 42 and the neck 54 of the bottle. Generally, the entire interior surface of the bottle will be rinsed by the water 52 spraying out of the port 50 of the bottle rinsing apparatus 34.

Advantageously, the bottle rinsing apparatus 34 of the present invention is designed to be particularly simple for a consumer to operate. It does not employ any sophisticated mechanisms for securing the bottle to the bottle rinsing housing 36 to keep the bottle from being propelled off the bottle rinsing apparatus 34 during rinsing. Indeed, the present invention is configured such that the weight of the bottle is sufficient to keep the bottle positioned on the bottle rinsing housing 36 of the bottle rinsing apparatus 34 during the rinsing process.

As illustrated in FIG. *2a*, the bottle rinsing nozzle 48 is configured with a plurality of ears 53 which extend longitudinally along the length of the bottle rinsing nozzle 48. By configuring ears 53 in the bottle rinsing nozzle 48, channels 55 between each pair of adjacent ears 53 are provided through which water sprayed into the bottle 38 may drain. Also, ears 53 provide support for the bottle 38 to maintain the bottle 38 vertically disposed during the rinsing process.

Port 50 is configured such that a substantial portion of the water 52 directed through the port 50 and onto the interior of the bottle 38 is directed against the interior walls 56 of the bottle. Thus, a portion of the kinetic energy of the water sprayed against the interior walls 56 is dissipated by pressing outwardly against the walls of the bottle, in the direction of arrow A. Of course, a force exerted on the interior walls 56 of the bottle 38 in the direction of arrow A does not tend to lift the bottle 38 off the bottle rinsing housing 36.

Importantly, notwithstanding this energy-dissipating feature of the bottle rinsing apparatus 34, the pressure in water line 46 must be adjusted at an appropriate level. If the pressure driving the water 52 through the port 50 is too high, the water 52 may have sufficient momentum to lift the bottle 38 off the bottle rinsing housing 36. In a presently preferred embodiment, a back pressure of approximately 35 to 50 psi in water line 46 with a flow rate through port 50 of approximately 0.25 gallons to about 0.5 gallons per minute will satisfactorily rinse the interior of bottle 38 while permitting the weight of the bottle 38 to keep the bottle 38 positioned on the bottle rinsing housing 36.

The bottle rinsing apparatus 34 is further configured with a bottle detector for verifying the presence of a bottle 38 on the bottle rinsing housing 36 prior to commencing a flow of water 52 through the nozzle 48. In a presently preferred embodiment of the invention, the bottle detector comprises a mercury switch 58 attached to a proximal end 60 of a sensing arm 62. Sensing arm 62 is pivotally mounted at pin 64 to base 40 and extends into the interior portion of the base 40.

Sensing arm 62 is configured such that when a bottle 38 is positioned on the bottle rinsing apparatus 34, the neck 54 of the bottle will engage a distal end 66 of sensing arm 62 and rotate sensing arm 62 about pin 64 in a clockwise direction as viewed in FIG. 2. Rotation of sensing arm 62 about pin 64 causes mercury switch 58 to rotate past a horizontal position, thereby forcing a mercury bubble 68 within the switch 58 to move to the opposite end of the switch 58, thereby actuating the switch 58, as illustrated in FIG. 2. Thus, by monitoring with the CPU whether mercury switch 58 has been actuated, a bottle 38 positioned on the bottle rinsing apparatus 34 may be detected.

When the bottle 38 is removed from the bottle rinsing apparatus 34, sensing arm 62, acted on by the force of gravity, will rotate about pin 64 in a counterclockwise direction as viewed in FIG. 2, and the mercury switch 58 will rotate downwardly past the horizontal position. The corresponding change in the angle of disposition of the mercury switch 58 causes the mercury bubble 68 to move to the opposite end of the switch 58, thereby actuating the switch 58 and sending a corresponding signal to the CPU.

Importantly, should a consumer attempt to remove the bottle 38 from the bottle rinsing apparatus 34 while water 52 is being sprayed through the nozzle 48, the mercury switch 58 would be immediately actuated. The corresponding signal would be received by the CPU and, in response, the flow of rinse water 52 through nozzle 48 would be immediately discontinued.

Figure 3:
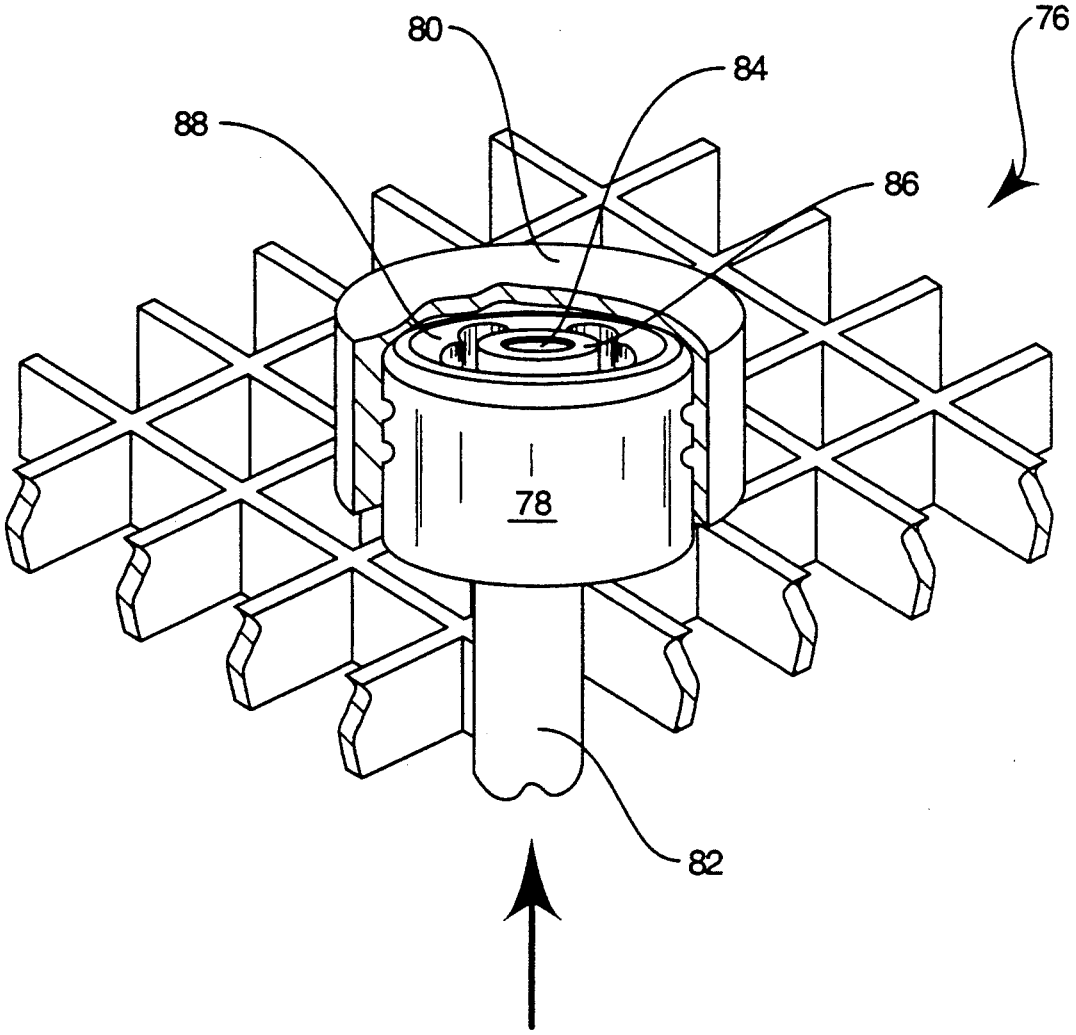
FIG. 3 is a perspective view of the cap rinsing apparatus of the present invention with portions broken away to more clearly illustrate the apparatus and its function.

The bottle and cap rinsing station further includes a cap rinsing apparatus 76, as is illustrated in FIG. 3. The cap rinsing apparatus includes a cap rinsing housing 78 configured to receive a conventional bottle cap 80, such as those commercially available plastic bottle caps designed for use with one liter or two liter plastic bottles.

The cap rinsing housing 78 is attached to a cap rinsing nozzle 82 such that the cap rinsing nozzle 82 extends through the center of the cap rinsing housing 78. Cap rinsing nozzle 82 is configured with a channel 84 extending therethrough and through which water may pass to rinse the interior of cap 80. In use, a flow of water is discharged upwardly through the channel 84 in the cap rinsing nozzle 82. The water exits the channel 84 at the head 86 of the cap rinsing nozzle 82 to rinse the cap 80.

The channel 84 is of sufficient cross-sectional area that the water exiting the channel 84 at head 86 does so in a "bubbling" fashion. The water then travels along the interior surface of the cap 80 in the space between the cap 80 and the cap rinsing housing 78, thereby gently rinsing the cap 80. In use, the cap 80 will float upon the layer of water which is flowing between the upper surface 88 of the cap rinsing housing 78 and the cap 80. Thus, the back pressure driving the water through channel 84 should be regulated such that any force exerted by the water on the cap 80 will permit the cap to remain disposed upon the cap rinsing housing 78 while being rinsed.

A single water line is preferably employed for supplying rinse water to both cap rinsing apparatus 76 and bottle rinsing apparatus 34. Thus, a throttling valve (not shown) is preferably employed on the line to the cap rinsing apparatus 76 to reduce the flow rate of the water directed through cap rinsing nozzle 82 and thereby ensures that the water exits cap rinsing nozzle 82 in a "bubbling" fashion. It is also preferred that a supply of both hot and cold rinse water be provided to the bottle and cap rinsing station 12. Hence, both a hot and a cold water line are connected to the common water line supplying rinse water to the bottle and cap rinsing station 12. In a preferred embodiment of the invention, a hot-water solenoid valve (not shown) is utilized to connect the hot water line into the common supply line and a corresponding cold-water solenoid valve (not shown) is utilized to connect the cold water line into the common supply line. Each of these solenoid valves may be alternately opened or closed in response to an appropriate signal from the CPU.

In using the bottle and cap rinsing station 12 in accordance with the process of the present invention, a consumer, or user, will generally desire to rinse a bottle 38 and cap 80 before dispensing a beverage into the bottle. The user initially approaches the bottle rinsing apparatus 34 in its "rest state." In this "rest state," the bottle and cap rinsing station 12 is ready to be utilized for rinsing a bottle 38 and a cap 80. Also while in the rest state, a light 96 (FIG. 1) marked "ready" on the control panel 98 of the upper section 26 of the cabinet 24 is lit, thereby indicating to the user that the rinsing apparatus is operational. The bottle and cap rinsing station 12 will stay in its rest state until a bottle 38 is placed on the bottle rinsing housing 36 by a user.

Thus, with the bottle and cap rinsing station 12 in its rest state, the consumer places a bottle 38 in an inverted position on the bottle rinsing housing 36, as illustrated in FIG. 2. The user may also place a cap 80 on the cap rinsing housing 78, as viewed in FIG. 3.

As viewed in FIG. 2, placement of the bottle 38 on the bottle rinsing housing 36 actuates the mercury switch 58, thereby sending a signal to the CPU that a bottle 38 is ready to be rinsed. In response to the signal from the mercury switch 58, a "press start" light 100 on the control panel 98 comes on, thereby indicating to the user that rinsing will begin as soon as the user presses a "start" button 102, also positioned on the control panel 98 (FIG. 1).

After the user presses the "start" button 102, the CPU sends a signal which opens the hot-water solenoid valve, thus commencing a flow of hot water through the common rinse water supply line and into the bottle 38 and cap 80. At this point, the "press start" light 100 goes out and a "rinsing" light 104 on the control panel 98 comes on.

Advantageously, the weight of the bottle 38, the rinse water pressure and the configuration and location of the port 50 in the nozzle 48 combine to maintain the bottle 38 in its proper inverted rinsing position, as shown in FIG. 2, without any further action by the user or the use of any complicated retaining mechanisms. Thus, the bottle rinsing apparatus 34 permits easy and rapid placement of bottles on the bottle rinsing housing 36, and equally efficient removal of the rinsed bottle.

After rinsing the bottle 38 and cap 80 with hot water for a predetermined period of time, preferably about 10 to 12 seconds, the CPU signals the hot-water solenoid valve to close, thereby discontinuing the flow of hot water into the bottle 38 and cap 80. The CPU then signals the cold-water solenoid valve to open, thereby commencing a flow of cold water through the common rinse water line and into the bottle 38 and cap 80.

Rinsing the bottle 38 with cold water assists in the rinsing process and also serves to remove any heat from the bottle 38 which would otherwise tend to raise the temperature of any beverage subsequently dispensed into the bottle 38. Finally, after rinsing the bottle 38 and cap 80 with cold water for approximately four seconds, the CPU sends a signal to the cold water solenoid valve to discontinue the flow of cold water into the bottle 38 and cap 80.

Once the flow of cold water into the bottle 38 and cap 80 is discontinued, the rinsing process is complete and the "rinsing" light 104 goes out. As the user may desire to rinse the bottle 38 more than once without removing it from the bottle rinsing housing 36, the CPU next turns on the "press start" light 100 and waits for the user to either remove the bottle 38 or press the "start" button 102 once again. If the user presses the "start" button 102 again, the rinsing process is repeated in the fashion just described. Upon removal of the bottle 38 from the bottle rinsing housing 36 following completion of the rinsing process, the bottle and cap rinsing station 12 returns to its rest state, with the "ready" light 96 again lit.

In a presently preferred embodiment, the CPU constantly monitors mercury switch 58 to verify that a bottle 38 is positioned on the bottle rinsing housing 36 during the entirety of the rinsing process. As long as the mercury switch 58 is actuated by the bottle 38 being positioned on the bottle rinsing housing 36, the CPU is signalled that a bottle 38 is present.

If the bottle 38 is removed prior to the completion of the rinsing process, the mercury switch 58 is actuated and a corresponding signal is sent to the CPU. In response, the CPU will immediately signal the hot or cold water solenoid valve, as appropriate, to discontinue the flow of rinse water. Thus, should a user inadvertently remove the bottle 38 from the bottle rinsing housing 36 before the rinsing process is complete, the flow of rinse water through the bottle and cap rinsing station 12 is immediately discontinued, thereby preventing the user from being sprayed with water.

Figure 4:
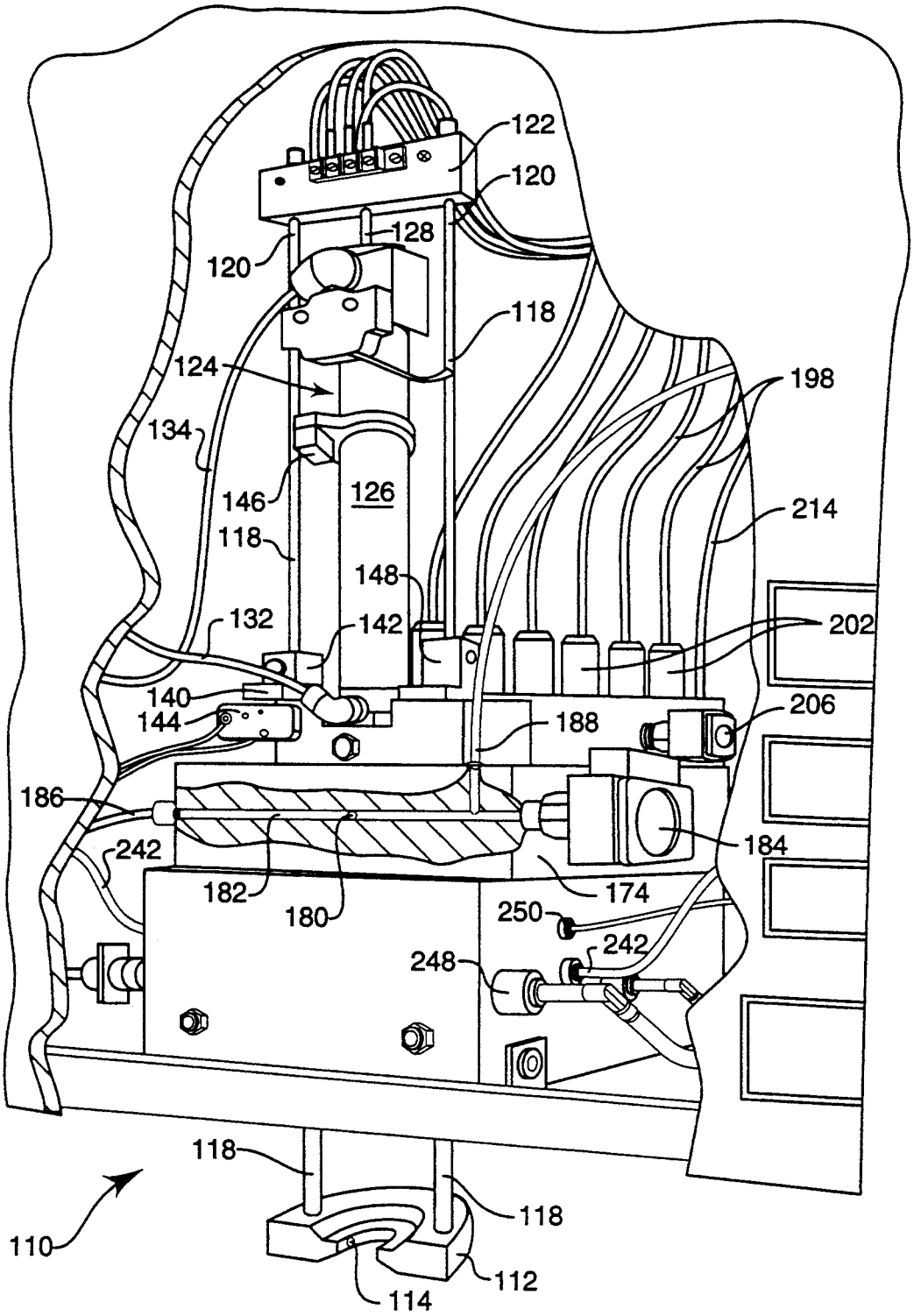
FIG. 4 is a perspective view of the beverage dispensing device of the present invention taken along line 4—4 of FIG. 1, with portions broken away to more clearly illustrate the device.
Figure 5:
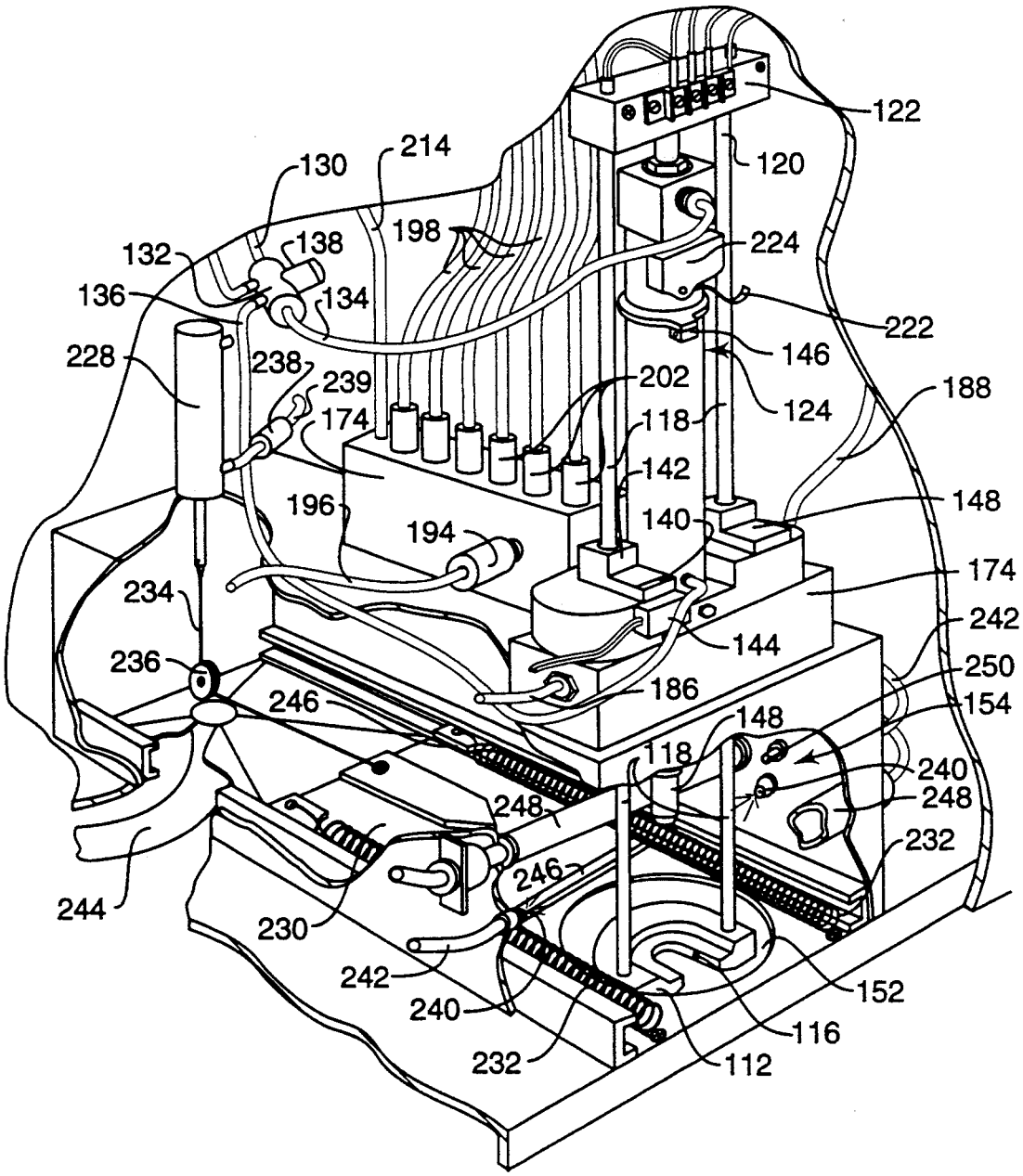
FIG. 5 is a second perspective view of the beverage dispensing device illustrated in FIG. 4, with portions broken away to more fully illustrate the beverage dispensing chamber.

With reference now to FIGS. 4 and 5, a beverage dispensing device 110 used to dispense beverage at each beverage dispensing station 14 is illustrated. The beverage dispensing device 110 includes a yoke 112 configured for engaging a bottle. The yoke is preferably configured in a "U" shape such that the neck of a bottle may rest on the yoke and be supported by the yoke.

Yoke 112 includes a bottle sensing device for determining whether a bottle has been placed in yoke 112. It is presently preferred that the bottle sensing device comprise an infrared emitter 114 (FIG. 4) and an infrared detector 116 (FIG. 5) disposed collinearly on opposite sides of the yoke 112. Thus, with a bottle placed on the yoke 112, the infrared emitter 114 will emit a beam of infrared light through the neck of the bottle and the infrared detector 116 will measure the intensity of the beam which penetrates the neck of the bottle.

The infrared emitter and detector are operated by signal sent from the CPU. Thus, by measuring the amount of attenuation of the infrared beam across the yoke 112, a determination of whether a bottle is positioned in the yoke 112 can be made. A plastic bottle, such as those described as preferable for use with the present invention, when placed in the yoke will attenuate the infrared beam a substantial amount, but not completely. However, if the beam is completely attenuated, then it is assumed that the object in the yoke is not a bottle.

The yoke 112 is attached to and supported by retract shafts 118. The upper ends 120 of retract shafts 118 are attached to a bar 122. Bar 122 is supported at its center by a lifting ram 124. Lifting ram 124 comprises a cylindrical member 126 within which is disposed a pneumatically driven piston 128. The opposite end of piston 128 is connected to bar 122.

Ram 124 is preferably driven by pressurized $CO_2$, such as that commercially available and generally utilized in generating carbonated water in conventional beverage dispensing machines. As is explained below, the present invention also utilized pressurized $CO_2$ in preparing carbonated water. Hence, by utilizing this source of pressurized air as the driving fluid for ram 124, the requirement for an exterior energy source for this purpose is eliminated.

As best illustrated in FIG. 5, a $CO_2$ drive line 130 extends from a source of pressurized $CO_2$ (not shown) and attaches to a four-way solenoid valve 132. Coming out of the four-way valve 132 is an upper $CO_2$ line 134 and a lower $CO_2$ line 136. The fourth line 138 of four-way valve 132 is open to the ambient air.

In operation, four-way solenoid valve 132 is controlled by the CPU. When it is desired to raise the yoke 112, valve 132 is actuated such that lower line 136 is pressurized with $CO_2$ supplied from $CO_2$ drive line 130 and upper line 134 is exposed to the ambient air line 138. Thus, the cylinder 126 below the piston 128 is pressurized, resulting in the piston 128 being raised. To lower the yoke 112, valve 132 is actuated such that upper line 124 is pressurized by $CO_2$ drive line 130 and lower line 126 is exposed to the ambient air line 138.

In operation, the yoke 112 is placed in the fully extended position illustrated in FIG. 4 such that a consumer may place a beverage bottle on the yoke 112. To provide a verification to the CPU that the yoke 112 is appropriately positioned in the fully extended position, a magnet 140 is attached to a switch clip 142 which, in turn, is attached to one of the retract shafts 118. A lower magnetic switch 144 is positioned such that it will be aligned adjacent to magnet 140 when the ram 118 is in its fully extended position.

Figure 6:
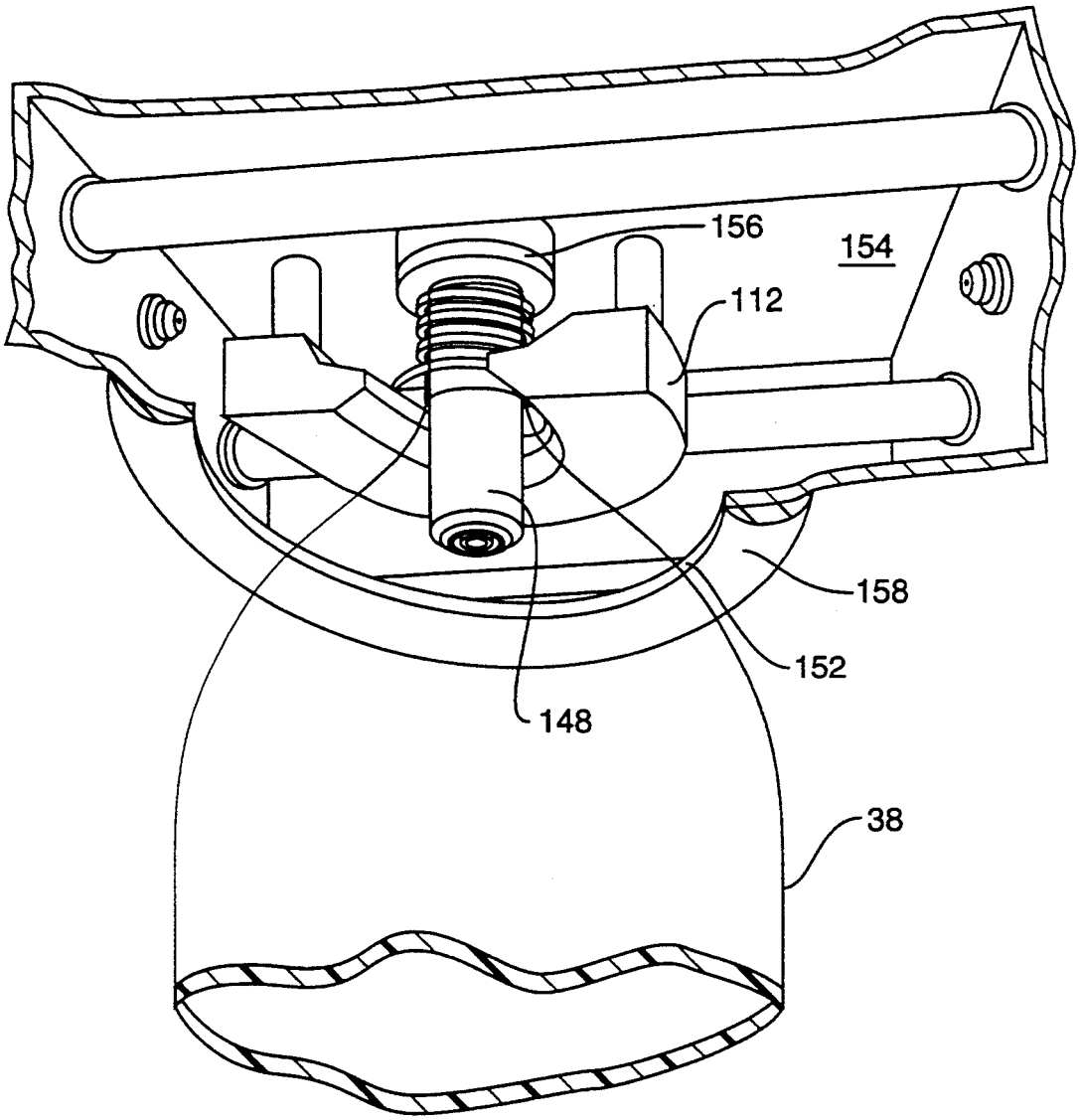
FIG. 6 is a perspective view of the beverage dispensing chamber of the present invention, with a bottle retracted into the chamber in a fill position, and with portions of the dispensing chamber broken away to more fully illustrate the interior features of the chamber.

An upper magnetic switch 146 is attached to the ram 124 and will be aligned with magnet 140 when the yoke 112 retracts a bottle to the fill position (FIG. 6). In use, however, the upper magnetic switch is used in determining whether the bottle placed on the yoke 112 has a cap on it. If the bottle does have a cap on it, when the ram 124 attempts to retract the yoke 112, the cap will strike the lower portion of a beverage dispensing nozzle 148 within the beverage dispensing device 110 and prevent the bottle from retracting into the fill position. Consequently, upper magnetic switch 146 will stay open. The CPU, now having received a signal that upper magnetic switch 146 is closed, will assume that the ram 124 has not retracted to the fill position because a cap is on the bottle.

When a bottle is placed on the yoke 112 without a cap on it, the yoke 112 may be retracted to engage the bottle with the beverage dispensing nozzle 148. As viewed in FIG. 6, a bottle 38 is retracted through an opening 152 in a beverage dispensing chamber 154. Continued retraction of bottle 38 disposes the beverage dispensing nozzle 148 within the bottle 38. The bottle 38 is brought to rest against a seal 156 which seals the beverage dispensing nozzle 148 within the bottle 38. Importantly, the seal between bottle 38 and seal 156 is maintained under the force of ram 124, as driven by the pressurized $CO_2$. Thus, during the entire dispensing process, the pressurized $CO_2$ in ram 124 maintains a constant force on bottle 38, ensuring its seal to the beverage dispensing nozzle 148.

A pressure sensitive tape 158 is disposed about the opening 152 of the beverage dispensing chamber 154. The pressure sensitive tape 158 is placed in communication with the CPU such that it will send a signal to the CPU upon the application of a predetermined pressure to the tape 158. Consequently, should any object, such as a consumer's hand or fingers, be on the bottle 38 as it is retracted through the opening 152 into the dispensing chamber 154, the pressure sensitive tape 158 will be actuated and the yoke 112 may be lowered in response.

Figure 7:
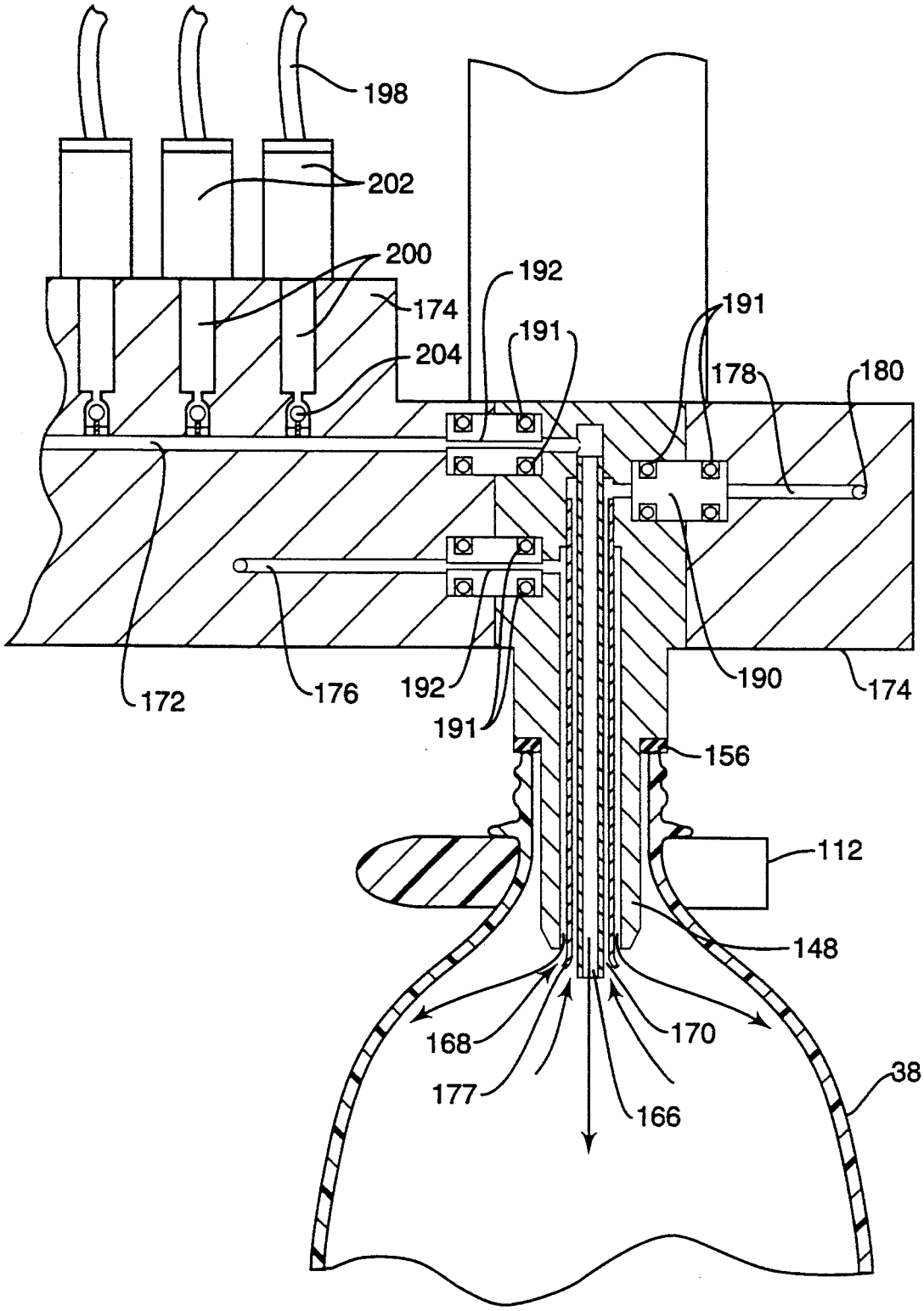
FIG. 7 is a cross sectional view of the head manifold and beverage dispensing nozzle of the present invention, with a bottle in the fill position, and illustrating a beverage being dispensed into the bottle.

With the yoke 112 retracted to hold the bottle in the fill position, as illustrated in FIG. 6, beverage may be dispensed into the bottle. As best illustrated in FIG. 7, the beverage dispensing nozzle 148 includes three ports—a syrup port 166, a carbonated water port 168 and a relief port 170. The syrup port 166 is positioned in the center of the beverage dispensing nozzle 148 and is in fluid communication with a common syrup chamber 172 in a head manifold 174. Through the syrup port 166, a foamable component of the beverage such as a syrup flavoring is introduced into the center of the bottle 38.

The carbonated water port 168 is configured as a cylindrically shaped channel extending concentrically about the syrup port 166. The carbonated water port 168 is in fluid communication with a carbonated water input line 176. Hence, carbonated water may be directed into the bottle 38 through the carbonated water port 168.

As used herein, a "non-foamable component" of a beverage is that component which is carbonated, and a "foamable component" may include any component of the beverage having sufficient surface tension that it may produce foam under certain conditions. Thus, when mixing foamable and non-foamable beverage components under circumstances wherein a substantial temperature and/or pressure differential exists, foam will generally be produced.

The beverage dispensing nozzle is further configured with a directing tip 177 to direct the carbonated water onto the sides of the bottle 38. By directing the carbonated onto the sides of the bottle 38, laminar flow of the water is generally maintained, thereby significantly reducing the amount of foam generated in the bottle during the dispensing process.

Beverage dispensing nozzle 148 is preferably configured with sufficient length that it will extend into the bottle 38 a sufficient distance that carbonated water introduced into the bottle 38 through carbonated water port 168 may be directed onto the shoulders 42 of the bottle 38. Because the syrup is introduced into the center of the bottle 38 through syrup port 166, the carbonated water and syrup are not mixed until after they are each dispensed into the bottle.

The configuration of the beverage dispensing nozzle 148, as explained above, is preferred for use with foamable beverages, such as beverages including carbonated water and syrup flavoring, because the use of the nozzle 148 significantly reduces the amount of foam generated during the dispensing process. Of course, the dispensing nozzle 148 of the present invention may be successfully utilized with non-foamable beverages. Although, when dispensing non-foamable beverages it may be preferable to utilize a conventional beverage dispensing nozzle, while still taking advantage of the other features of the present invention, as discussed herein.

With continued reference to FIG. 7, the relief port 170 of the beverage dispensing nozzle 148 is positioned concentrically about the syrup port 166 and between the syrup port 166 and the carbonated water port 168. The relief port 170 provides a port through which the fluid being displaced by the beverage being dispensed into the container may exit the container. Hence, as carbonated water and syrup are directed into the bottle 38 through the carbonated water port 168 and the syrup port 166, respectively, the air within the bottle which is displaced by the beverage exits through relief port 170.

The beverage dispensing nozzle 148 is configured such that relief port 170 is placed in fluid communication with a relief line 178 configured within the head manifold 174. Relief line 178 connects at a tee 180 to a pressure sensing chamber 182 configured within the head manifold 174, as illustrated in FIG. 4.

In accordance with the teachings of the present invention, the fluid displaced by the beverage entering the bottle 38, is monitored within the pressure sensing chamber 182 for the presence of liquid to thereby determine when the bottle is full of beverage. Thus, a liquid detector is employed in fluid communication with relief port 170. In this preferred embodiment of the invention, the liquid detector comprises a pressure switch 184 attached to the head manifold 174 in fluid communication with the pressure sensing chamber 182.

Head manifold 174 is preferably made of a transparent acrylic plastic. Utilizing a transparent acrylic plastic in the construction of head manifold 174 enables any obstructions within any of the chambers or lines within the manifold 174 to be easily located upon visual inspection. Additionally, such an acrylic plastic is easily configured with the necessary chambers and lines which are included within manifold 174.

A drain line 186 connects the pressure sensing chamber 182 to a drain. Thus, drain line 186 is open to atmospheric pressure. When a bottle is being filled with a beverage, the fluid within the bottle which is displaced by the beverage passes through the relief port 170 (FIG. 7), through relief line 178 and into the pressure sensing chamber 182. Initially the fluid displaced by the beverage entering the bottle will be air. Thus, the pressure within the pressure sensing chamber 182 will be only slightly greater than ambient pressure.

However, as the bottle approaches its "full" line, foam will generally be displaced into the pressure sensing chamber 182 by the beverage entering the bottle. Upon entering the pressure sensing chamber 182, at least some of the foam will have settled, resulting in a volume of liquid within the pressure sensing chamber 182. Once a sufficient amount of liquid accumulates within the pressure sensing chamber 182, because of the incompressible nature of liquid, the pressure within the chamber 182 will increase to a point substantially above atmospheric pressure and pressure switch 184 will be actuated. In response to the signal from pressure switch 184, the CPU will cause the flow of beverage into the bottle 38 to discontinue.

When dispensing a non-foamable beverage with the apparatus of the present invention, determining when the bottle 38 is full is accomplished in the same manner. Instead of foam being displaced through the relief port 170, liquid beverage will be displaced when the level of the liquid within the bottle reaches the opening of the relief port 170. The liquid will then travel through the relief line 178 and into the pressure sensing chamber 182. As with a foamable beverage, the presence of liquid within the pressure sensing chamber 182 will actuate the pressure switch 184, resulting in the flow of beverage into the bottle being discontinued.

A flush line 188 is connected into the pressure sensing chamber 182 at a point between the tee 180 and the pressure switch 184. A sanitizing solenoid 189 (FIG. 8) is connected to a supply of hot rinse water. By actuating sanitizing solenoid 189, a pressurized flow of sanitizing water is permitted to flow through flush line 188. Thus, as explained in greater detail below, the pressure sensing chamber 182 may be flushed during the sanitizing process.

With reference again to FIG. 7, the beverage dispensing nozzle 148 is disposed within the head manifold 174. A collar 190 secured by 0-rings 191 is provided within relief line 178 to prevent leakage at the point of connection of the dispensing nozzle 148 to the head manifold 174 at the relief line 78. Similarly, narrowing collars 192 are provided for the carbonated water input line 176 and the common syrup chamber 172. Narrowing collars 192 not only act to insure the integrity of the connection, but also to reduce the cross-sectional area of the lines, thereby providing that sufficient back pressure is maintained in the water input line 176 and in the common syrup chamber 172.

Carbonated water input line 176 is connected at solenoid valve 194 to a carbonated water supply line 196 which contains a pressurized source of carbonated water, as viewed with reference to FIGS. 5 and 7. Thus, to dispense carbonated water into bottle 38, the CPU sends a signal to solenoid valve 194, thereby opening the valve and permitting a flow of carbonated water to pass into carbonated water input line 176, through carbonated water port 168 and into the bottle 38.

Head manifold 174 is connected to various syrup input lines 198 via syrup ports 200. Thus, for each flavor of syrup to be dispensed through the dispensing station, a syrup line 198 corresponding to that flavor is provided. The flow of syrup through syrup lines 198 and into the corresponding syrup port 200 is controlled by solenoid valves 202 positioned on the head manifold 174 at each syrup port 200. Thus, in response to a signal sent by the CPU to the appropriate solenoid valve 202, the syrup flavor selected by the consumer may be dispensed into its corresponding syrup port 200, through common syrup chamber 172, through syrup port 166 of the dispensing nozzle 148 and into the bottle 38.

Although shown in FIGS. 4 and 5 to be mounted to head manifold 174 in a collinear fashion, it is presently preferred that syrup input lines 198 be mounted with three lines entering the top of head manifold 174, as illustrated, but with the remaining three lines entering head manifold 174 from the side. By so configuring the head manifold 174, additional room is provided for the disposition of solenoids 202.

Each syrup port 200 is provided with a one-way valve 204 located between the syrup port 200 and the common syrup chamber 172. Thus, any syrup or other liquid traveling through common syrup chamber 172 will not enter any other syrup port 200, thereby preserving separate each flavor of syrup.

As viewed in FIG. 4, a pressure switch 206 is attached to the side of head manifold 174 and is connected in fluid communication with common syrup chamber 172 such that it may monitor the pressure in common syrup chamber 172. Thus, when dispensing a syrup flavoring through common syrup chamber 172, by monitoring the pressure through common syrup chamber 172, the presence of syrup in the line can be verified.

If there is syrup in line 172, the pressure in line 172 will be approximately equal to the back pressure of the syrup. If the supply of syrup has been depleted, the pressure in line 172 will be substantially lower. Thus, if the pressure in line 172 falls below a predetermined level, the pressure switch 206 is actuated thereby sending a signal to the CPU in response to which an "out-of-stock" light on the control panel 98 may be lit, thereby indicating to the consumer that the selected syrup flavoring is not available.

Monitoring is also conducted to ensure that a supply of carbonated water is present. In a presently preferred embodiment, a pressure switch 208 (illustrated schematically in FIG. 8) is positioned on the water supply line 282 coming into the apparatus 10 and a pressure switch 210 is located on the $CO_2$ supply line 320. As long as the pressures in both lines stay above a predetermined level, it is assumed that a supply of carbonated water is present. If the pressure in either supply line falls below a predetermined level, thereby actuating the corresponding pressure switch, the CPU will not permit the dispensing process to commence and will send a signal to display a message to the consumer that the machine is out of order.

The present invention employs a variety of mechanisms for sanitizing the invention after dispensing a beverage. Through the sanitizing process, any residual syrup flavoring within the syrup lines and in and on the beverage dispensing nozzle is washed away. Additionally, the sanitizing process includes measures to ensure that bacterial growth within the beverage dispensing chamber does not occur.

With continued reference to FIG. 4, a flush line 214 is connected into head manifold 174 at the end of all syrup input lines 198. Within head manifold 174, flush line 214 is connected in fluid communication with common syrup chamber 172. Flow through flush line 214 is commenced by actuating sanitizing solenoid 189 (FIG. 8) which controls the flow of hot water to all rinse lines during the sanitizing process. Like the syrup input lines 198, flush line 214 also employs a one-way valve (not shown) at its connection into common syrup chamber 172, thereby preventing any syrup from passing from the common syrup chamber 172 into the flush line 214.

During the sanitizing process, sanitizing solenoid 189 (FIG. 8) may be actuated by the CPU thereby permitting a flow of water to pass through the common syrup chamber 172 (FIG. 7) and through the syrup port 166 of the beverage dispensing nozzle 148. By connecting flush line 214 into common syrup chamber 172 at the end of all syrup input lines 198, the common syrup chamber 172 may be completely rinsed regardless of which input line 198 was utilized to discharge syrup through the common syrup chamber 172.

After dispensing a beverage into a bottle, the apparatus preferably completes a sanitizing cycle. During sanitizing, the yoke 112 is fully retracted to a position within the dispensing chamber 154. When the yoke 112 is fully retracted, switchclip 148 (FIG. 5) will depress an arm 222 on a microswitch 224 attached near the top of the ram 124.

Microswitch 224 is placed in communication with a pneumatic piston 228 which permits the closure of a chamber door 230, thereby isolating the dispensing chamber 154 from the consumer during the sanitizing process. In a presently preferred embodiment, chamber door 230 is biased towards the closed position by a pair of springs 232. A cable 234 is connected to the piston 228 at one end, extends about a pulley 236 and connects to the chamber door 230 at its opposite end.

Pneumatic piston 228 is driven by pressurized $CO_2$, as is ram 124. A solenoid 238 is actuated by a signal sent from the microswitch 224 to provide the piston 228 with a supply of pressurized $CO_2$ from a $CO_2$ supply line 239.

Thus, by actuating piston 228, the cable 234 exerts a retracting force on the chamber door 230 which overcomes the biasing force of the springs 232 and causes the door 230 to open. When it is desired to close the door 230, solenoid 238 is switched to a closed position, thereby allowing the $CO_2$ within piston 228 to vent to the atmosphere and permitting cable 234 to extend. The door 230 will then close under the force of the springs 232.

In this preferred embodiment of the invention, microswitch 224 is connected directly to piston 228. Thus, as the yoke 112 reaches its fully retracted position, microswitch 224 is actuated as switchclip 148 depresses the arm 222 on the microswitch 224. Actuation of switchclip 148 sends a signal to solenoid 238 resulting in the release of cable 234 and permitting the chamber door 230 to close. Following the sanitizing process, as the yoke 112 is lowered out of the dispensing chamber 154, microswitch 224 is actuated as switchclip 148 releases the arm 222. Upon actuation of switchclip 148, solenoid 238 is signaled, causing piston 228 to retract cable 234 to open chamber door 230, thereby permitting yoke 112 to be lowered through the opening 152 of the chamber 154.

With the chamber door 230 closed, the sanitizing process is conducted. As viewed in FIG. 5, a sanitizing spray nozzle 240 is mounted on each side of the dispensing chamber 154. Each spray nozzle 240 is fed by a sanitizing water line 242 connected to the nozzle 240. During the sanitizing process, hot water may be sprayed through nozzles 240 to clean the retract shafts 118, yoke 112, dispensing nozzle 148 and other objects within the interior of the dispensing chamber 154. Upon CPU actuation of sanitizing solenoid 189 (FIG. 8), a flow of hot water is discharged through spray nozzles 240.

The rear of the dispensing chamber 154 is configured with a drain 244 through which the water sprayed into the chamber 154 and flushed through the beverage dispensing nozzle 148 during the sanitizing process may be removed from the chamber 154. During the sanitizing process, some water may accumulate on the upper surface of the chamber door 230. To prevent this water from falling out of the dispensing chamber 154 through the opening 152 when the door 230 is opened, the door 230 is configured with a lip 246 extending along the sides and front edge of the door, as illustrated in FIG. 5. Thus, as the door 230 is opened by actuating piston 228, any accumulated water on the door 230 will be forced towards the drain 244 by the lip 246.

In addition to cleaning the interior of the dispensing chamber 154 with hot water through spray nozzles 240, the interior of the dispensing chamber 154 is also bathed with ultraviolet light to destroy any bacteria which may be found within the dispensing chamber 154. To this end, ultraviolet lights 248 are disposed within the dispensing chamber 154 and positioned on each side of the retract shafts 118.

An ultraviolet light detector 250 is mounted within the interior of the dispensing chamber 154. During the sanitizing process, the interior of the chamber 154 is exposed to the ultraviolet light for a predetermined period of time. In operation, the ultraviolet lights 248 are turned on in response to a signal from the CPU. Upon the detection of ultraviolet light by the ultraviolet light detector 250, a timer is activated to time the period of exposure. Thus, if the ultraviolet lights 248 are burned out or are otherwise not working, the ultraviolet light detector 250 will detect that condition and, in response, the CPU will shut down that beverage dispensing station 14. After the predetermined exposure period has elapsed, the ultraviolet lights 248 are turned off.

The use of the beverage dispensing station 14 is now described with reference to FIG. 1. In using the beverage dispensing station 14 in accordance with the process of the present invention, the consumer, or user, initially approaches the beverage dispensing station 14 in its "rest state." In this rest state, the beverage dispensing station 14 is ready to be utilized for dispensing a selected beverage into a bottle 38.

In a presently preferred embodiment, the message "WELCOME TO FOUNTAIN FRESH; PRESS DESIRED FLAVOR BUTTON" is displayed on the LCD character display 260 of the control panel 98, thereby indicating to the user that the beverage dispensing station 14 is operational. In the rest state, the yoke 112 is fully raised, the beverage dispensing device 110 having previously undergone a sanitizing cycle. The beverage dispensing station 14 will stay in its "rest state" until the user presses a button selecting a particular flavor of beverage.

Advantageously, the CPU monitors pressure switch 208 (FIG. 8) in the water supply line 282 and pressure switch 210 in the $CO_2$ supply line 320 continually, both in and out of the rest state, to verify that an adequate supply of water and $CO_2$exists, thereby ensuring that a quality beverage is dispensed. If either pressure switch 208 or pressure switch 210 signals the CPU that the pressure in either line is below a predetermined, acceptable level, a message such as "THIS FILLING STATION IS OUT OF ORDER; PLEASE MOVE TO ANOTHER FILLING STATION" is displayed on the character display 260 of the control panel 98. In an alternative embodiment, an audible alarm also sounds.

In utilizing the beverage dispensing device 110 of the present invention, the user will generally desire to select a particular beverage flavor for dispensing into a recyclable bottle. Thus, in the resting state, "out of stock" light 262 on the control panel 98 are lit as appropriate, as illustrated in FIG. 1, indicating to the user which flavors are unavailable due to lack of syrup.

An "out of stock" light 262 on a particular syrup flavoring is initially lit in response to the actuation of pressure switch 206 (FIG. 4) while attempting to dispense that particular flavor of syrup. The light 262 will stay lit until the supply of that particular syrup flavoring is restocked, at which time the service personnel press a "restock" switch (not shown) and thereby reset the "out of stock" lights 262.

The user selects a flavor by pressing a flavor button 264 on the control panel 98 which corresponds to the desired flavor of beverage, thereby actuating a switch which signals the CPU. In response to the user's selection of a flavor, the yoke 112 is lowered to the position illustrated in FIGS. 1 and 4. Also, a message such as "HANG BOTTLE FROM THE HOLDER THAT JUST DROPPED INTO VIEW" is displayed on the LCD character display 260.

Placement by the user of a bottle 38 on the yoke 112, attenuates the beam of infrared ("IR") light traveling across the yoke 112 from the IR emitter 114 (FIG. 4) to the IR detector 116 (FIG. 5). The IR detector 116 continually signals the CPU, thereby enabling the CPU to detect any reduction in IR light detected across the yoke 112, as well as the magnitude of any reduction.

The magnitude of the reduction in intensity of the beam of IR light across the yoke 112 is used to distinguish bottles from other objects. Placement on the yoke 112 of a plastic or glass bottle of the type commonly used to receive carbonated beverages results in a reduction in the intensity of IR light across the yoke 112 of approximately 20 to approximately 80 percent. Interruption of the IR light by a user's finger would result in approximately 90 to 100 percent reduction in the intensity of the beam across the yoke 112. Thus, if the reduction in detected IR light lies within the predetermined range corresponding to bottles, the CPU concludes that a bottle 38 has been placed in the yoke 112.

If no bottle is placed in the yoke 112 within approximately 10 seconds, an alarm will sound. If no bottle is placed in the yoke within 20 seconds from the time the yoke is lowered, the CPU raises the yoke 112 to its fully retracted position, the beverage dispensing chamber 154 is sanitized, and the beverage dispensing station 14 returns to its "rest state." If, however, the user places a bottle 38 in the yoke 112 within the time provided, the yoke 112 carries the bottle 38 upwardly towards the beverage dispensing nozzle 148 and into the fill position.

As viewed in FIG. 5, the yoke 112 is raised by CPU actuation of the four-way solenoid valve 132 to permit the flow of a pressurized fluid into lower line 136 and out of line 134. In a presently preferred embodiment, this pressurized fluid is pressurized carbon dioxide gas. The pressurized fluid in turn actuates the lifting ram 124, raising the yoke 112 until switch clip 142 actuates upper magnetic switch 146, thereby signalling the CPU that the yoke 112 is raised to the correct level for dispensing beverage.

Advantageously, switch clip 142 will not contact upper magnetic switch 146 if the user inadvertently leaves the cap on the bottle 38, since the beverage dispensing nozzle 148 butting against the cap will prevent the yoke 112 from raising to the correct level for dispensing beverage. Thus, if the upper magnetic switch 146 does not signal the CPU within a predetermined period of time after the four-way solenoid valve 132 is actuated to raise the bottle 38, about three seconds in a preferred embodiment, the CPU concludes that the bottle 38 is capped.

In response to a capped bottle, the CPU lowers the yoke 112 and informs the user of the problem by displaying a message such as "PLEASE REMOVE CAP FROM BOTTLE" on the LCD character display 260; in an alternative embodiment, the CPU also actuates an audible alarm. The CPU then waits indefinitely for the bottle 38 to be removed from the yoke 112 by the user.

If the bottle 38 is removed from the yoke 112, but no bottle 38 is placed back in the yoke 112 within about 20 seconds after its removal, the CPU raises the yoke 112, sanitizes the beverage dispensing chamber 154, and returns the beverage dispensing station 14 to its rest state. If a capped bottle is placed in the yoke 112, the cap will be detected in the manner just described. If an uncapped bottle is placed in the yoke 112 within the specified time, the yoke 112 is raised and the dispensing process proceeds apace.

The dispensing process may be interrupted by the user at any time by pressing a "cancel" button 266 on the control panel 98 of FIG. 1. In response to a signal from the "cancel" button 266, the CPU causes a message such as "CANCEL BUTTON PRESSED!! PLEASE WAIT A FEW SECONDS" to appear on the LCD character display 260. The CPU also stops any beverage flow, lowers the yoke 112, waits for the user to remove the bottle 38 from the yoke 112, raises the empty yoke 112, and sanitizes the beverage dispensing device 110. In short, pressing the "cancel" button 266 discontinues any filling and returns the dispensing apparatus to its "rest state."

Retraction of the yoke 112 to the correct level for dispensing actuates upper magnetic switch 146, thereby sending a signal to the CPU that the bottle 38 in the yoke 112 is ready to be filled. In response to the signal from the upper magnetic switch 146, the CPU actuates solenoid valve 194 to permit the flow of carbonated water from the carbonated water supply line 196 into carbonated water input line 176, into the beverage dispensing nozzle 148, and out the carbonated water port 168 into the bottle 38.

The CPU also actuates the solenoid valve 202 corresponding to the selected beverage flavor thereby permitting the selected syrup to flow from line 198 into the common syrup chamber 172, into the beverage dispensing nozzle 148, and out the syrup port 166 into the bottle 38.

As the flow of beverage into the bottle starts, the CPU begins monitoring pressure switch 184 to detect a sufficiently full bottle in the manner described below.

Advantageously, the carbonated water is directed by carbonated water port 168 onto an interior sidewall of the bottle 38, as illustrated in FIG. 7. Simultaneously, the syrup is directed through syrup port 166 into the center of the bottle 38, away from any interior sidewall. This unique fill process greatly reduces foaming, traditionally a significant problem in consumer-operated beverage dispensing devices. The syrup and the carbonated water mix within the bottle thereby providing a substantially uniform beverage mixture.

As the bottle 38 is being filled with beverage, the CPU monitors pressure switch 184 to detect when the bottle 38 is full of beverage, regardless of the size of the bottle and without requiring any monitoring of the fill process by the user. Hence, the present invention represents a great improvement because, in the art of consumer-operated beverage dispensing devices, it has generally been necessary to either restrict variation in bottle size or to have users monitor the filling process.

As the beverage level in the bottle 38 approaches the full line, some foam will move through relief port 170 and into the pressure sensing chamber 182 where the pressure is being monitored by the pressure switch 184. In a presently preferred embodiment, pressure switch 184 detects the presence of liquid in the chamber by sensing a change of pressure. However, alternative embodiments may employ other types of detectors to accomplish this same function. Upon actuation of the pressure switch 184, the CPU causes solenoid valve 194 and the appropriate solenoid valve 202 to be actuated thereby preventing further flow of carbonated water and syrup through the dispensing nozzle 148.

In a presently preferred embodiment, the CPU then waits approximately two to three seconds for any foam which has been generated in the bottle 38 to settle. After this waiting period has elapsed, the CPU again actuates solenoid valve 194 and the appropriate solenoid valve 202, thereby permitting additional flow of carbonated water and syrup through the beverage dispensing nozzle 148 to "top off" the bottle. Again, the pressure switch 184 is actuated when the bottle is sufficiently full and sends a corresponding signal to the CPU. In response to this second signal from pressure switch 184, the CPU discontinues the flow of beverage into the bottle and lowers the yoke 112 to present the filled bottle 38 to the user.

The yoke 112 is lowered by CPU actuation of the fourway solenoid valve 132 to release $CO_2$ out of lower $CO_2$ line 136 and into upper $CO_2$ line 134, until magnet 140 on switch clip 142 closes lower magnetic switch 144, thereby signalling the CPU that the yoke 112 is fully lowered. The LCD character display 260 then displays a message such as "REMOVE AND CAP YOUR BOTTLE; WE APPRECIATE YOUR PATRONAGE", indicating that the user should remove the filled bottle 38 from the yoke 112 and cap it.

Upon removal of the bottle 38 from the yoke 112 by the user, the amount of IR light detected by IR detector 116 in the yoke 112 will approach full strength, i.e., approximately 100 percent intensity, thereby indicating to the CPU that the filled bottle 38 has been removed from the yoke 112. If the filled bottle 38 is not removed from the yoke 112 within a predetermined period of time, preferably about 20 seconds, a message such as "PLEASE REMOVE YOUR BOTTLE, THIS STATION NEEDS TO BE SANITIZED" appears on the LCD character display 260; in an alternative embodiment, an audible alarm also sounds. The CPU will wait indefinitely for the filled bottle 38 to be removed. After the filled bottle 38 is removed from the yoke 112, the yoke 112 will fully retract into the beverage dispensing chamber 154 and the beverage dispensing station 14 will be sanitized.

In the preferred embodiment illustrated in FIG. 6, pressure sensitive tape 158 positioned about the opening 152 of the beverage dispensing chamber 154 signals the CPU when a user's fingers or other foreign object is being drawn into the beverage dispensing chamber 154 by the rising yoke 112. In response to a signal from the pressure sensitive tape 158, the CPU immediately lowers the yoke 112, waits a predetermined period of time, approximately two seconds, and then attempts to raise the yoke 112 again.

As viewed in FIG. 5, full retraction of the yoke 112 within the beverage dispensing chamber 154 actuates microswitch 224, thereby signalling solenoid 238 and closing the chamber door 230. As the yoke 112 is raised, the CPU monitors the status of lower magnetic switch 144 and upper magnetic switch 146. As retraction of yoke 112 commences, lower magnetic switch 144 is opened. The CPU then monitors for upper magnetic switch 146 to set as the magnet 140 moves past a position of alignment with it on its way to a fully retracted position.

Upon setting upper magnetic switch 146 as the yoke 112 is being fully retracted for sanitizing, a three-second delay is observed by the CPU prior to commencing the sanitizing process. The three-second delay provides time in which the chamber door 230 may close. Alternatively, a signal from microswitch 224 could be sent to commence a delay time for closing door 230 prior to commencing the sanitizing process.

As the yoke 112 reaches the fully retracted position, microswitch 224 is actuated, thereby signalling the actuation of piston 228 via solenoid 238 and releasing the force which holds the chamber door 230 open against the biasing force of springs 232. Springs 232 thus pull the chamber door 230 shut. At about the same time, the LCD character display 260 displays a message such as "PLEASE WAIT A FEW SECONDS; THIS STATION IS BEING SANITIZED." In an alternative embodiment, the signal from microswitch 224 could go to the CPU and the CPU could control the actuation of solenoid 238 and piston 228.

With the chamber door 230 closed, the apparatus is ready to be sanitized. Advantageously, the present invention utilizes two distinct sanitizing mechanisms in its preferred embodiment, to wit, an omni-directional pressurized hot water spray, and anti-bacterial, ultra-violet light.

The sanitizing process begins as the CPU repeatedly actuates sanitizing solenoid 189, thereby permitting a pulsed pressurized flow of hot water from sanitizing water line 242 through nozzles 240 into the beverage dispensing chamber 154. The combination of pressure, nozzle size, nozzle configuration, nozzle location, and chamber walls serves to produce an essentially omni-directional spray of hot water within the chamber 154, thereby rinsing and sanitizing the retract shafts 118, yoke 112, dispensing nozzle 148 and the interior of chamber 154.

CPU actuation of sanitizing solenoid 189 (FIG. 8) also permits pulsed pressurized hot water to flow through flush line 214 and into common syrup chamber 172, thereby flushing residual syrup from the common syrup chamber 172 into the beverage dispensing chamber 154. The pulsating flow of sanitizing hot water also flows through flush line 188 to rinse the pressure sensing chamber 182. After approximately five pulses, the CPU stops actuating sanitizing solenoid 189, thereby discontinuing the hot water spray and flush.

Advantageously, the use of pulses serves both to inject greater pressure in the lines being cleansed, and to permit substantially all used water to drain away through drain 244 during the pulsing. It is also important to note that the raised lip 246 configured in the chamber door 230 aids in preventing water which accumulates on the surface of chamber door 230 from falling out of the dispensing chamber 154 when the door opens. Indeed, the lip 246 in chamber door 230 forces the accumulated water to retract with the door 230, thereby enabling it to drain through drain 244.

Essentially simultaneously with commencing the pulsed flushing of the system with hot water via solenoid 189, the CPU also actuates UV lights 248, thereby bathing the dispensing nozzle 148, yoke 112 and the interior of chamber 154 in anti-bacterial light. The CPU monitors the strength of the UV light in the chamber 154 through signals sent to the CPU from UV detector 250, thereby detecting worn-out or defective UV lights so they can be replaced. After the UV lights 248 have been on for at least about five seconds, the CPU shuts off the UV lights, thereby signaling the completion of the sanitizing process. The "welcome" message is again displayed on the LCD character display 260. At this point, the beverage dispensing station 14 is once more in its rest state, awaiting a flavor selection from a user.

Figure 8:
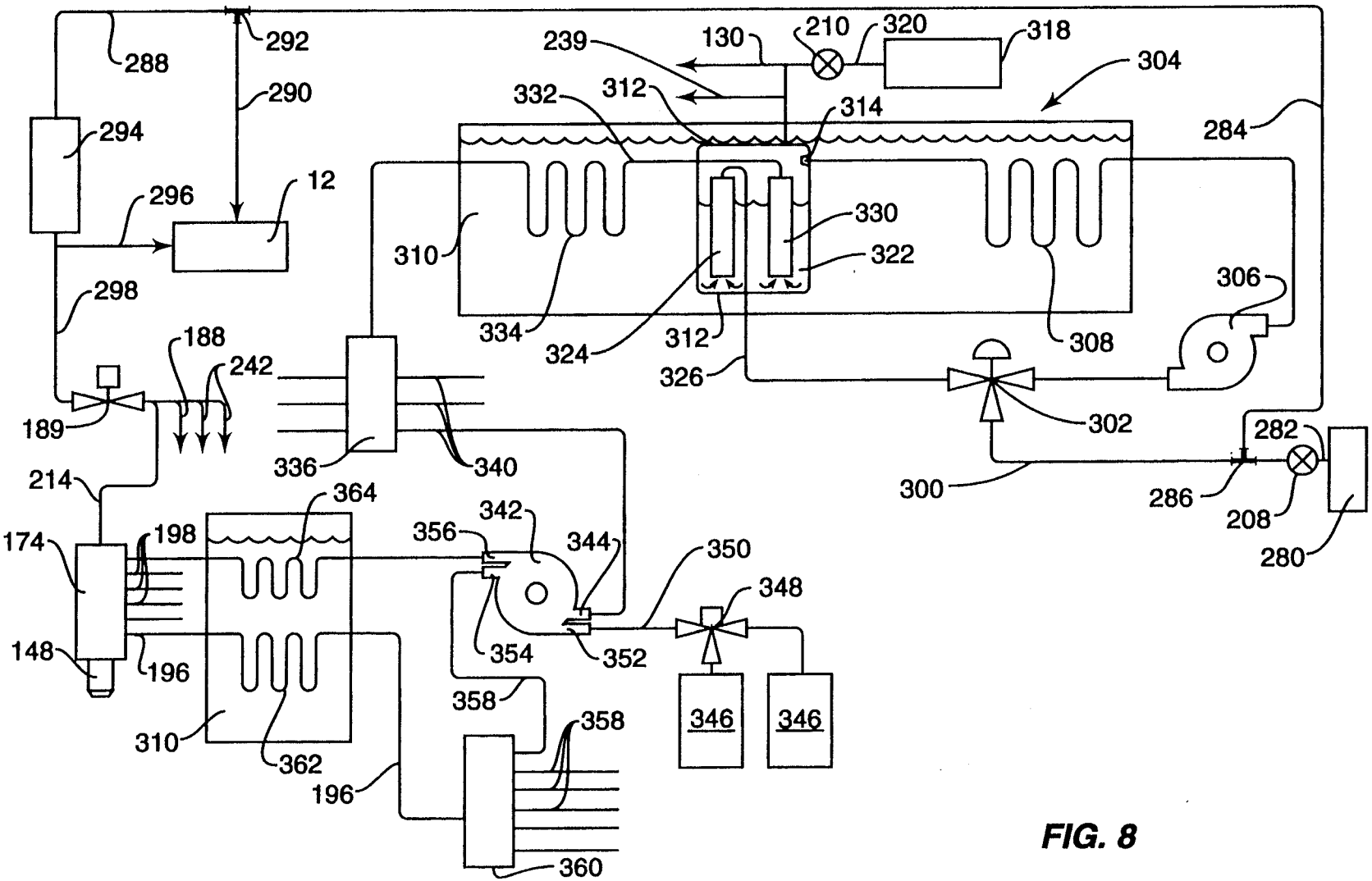
FIG. 8 is a schematic drawing illustrating the treatment of water and syrup flavoring in accordance with the present invention.

With reference now to FIG. 8, a schematic diagram illustrating the treatment of input water and syrup lines is set forth. The apparatus of the present invention preferably utilizes an external water source, such as treated water 280 from a municipal water supply line. Such a conventional source of treated water 280 will generally be available at a pressure of approximately 60 psi and a temperature of from about 38 to about 95 degrees Fahrenheit.

A pressure switch 208 is provided on a treated water supply line 282. Pressure switch 208 is monitored by the CPU to provide a verification that a supply of treated water 280 is available for use by the system.

A sanitizing and rinse line 284 comes off treated water supply line 282 at a tee 286. Sanitizing and rinse line 284 separates into hot 288 and cold 290 water lines at tee 292. Cold water line 290 is connected into the bottle and cap rinsing station 12. Hot water line 288 is passed through a water heater 294 where it is heated to approximately 120 degrees Fahrenheit. Water heater 294 may include any of those conventionally available heat exchangers for use in heating a supply of treated water 280.

A hot water rinse line 296 provides a supply of the heated water from the heater 294 into the bottle and cap rinsing station 12. Thus, both hot water rinse line 296 and cold water line 290 supply the bottle and cap rinsing station 12. As previously explained, both lines are connected in fluid communication with the cap rinsing nozzle 82 of the cap rinsing apparatus 76 (FIG. 3) and with the water line 46 of the bottle rinsing apparatus 34 (FIG. 2).

A sanitizing line 298 also provides a supply of hot water out of heater 294 to use in sanitizing the beverage dispensing device 110. Sanitizing solenoid 189 is placed in sanitizing line 298 by which flow through the lines may be controlled by the CPU. Hence, by actuating sanitizing solenoid 189, flush line 214, flush line 188 and water line 242 are all charged with hot water.

A fresh water supply line 300 also comes off tee 286 to provide a supply of water from which carbonated water is generated. A three-way valve 302 is provided in the carbonated water line by which the flow of water into a carbonation recirculation system 304 is controlled. To add water to the carbonation recirculation system 304, three-way valve 302 is actuated thereby permitting treated water 280 to flow through fresh water supply line 300 and into a recirculation loop.

Upon passing through three-way valve 302 and entering the carbonation recirculation system 304, the water passes through a pump 306 which boosts the pressure in the system up to approximately 100 psi, in a presently preferred embodiment.

The carbonation recirculation system 304 further includes a pre-carbonation cooling coil 308 which is immersed in an ice-water bath 310 located within the upper section 26 of the cabinet 24 (FIG. 1). From the pre-carbonation cooling coil 306, the water enters the carbonator 312 by passing through an atomizing nozzle 314. The carbonator 312 is also immersed in ice-water bath 310. Atomizing nozzle 314 employed in dispersing the water as it enters the carbonator 312 may be any of those nozzles known for use in generating carbonated water.

A supply of carbon dioxide gas is provided in a pressurized $CO_2$ tank 318, such as those conventionally employed and commercially available in the soft drink industry. Pressure switch 210 is provided on a supply line 320 to enable the CPU to verify whether a pressurized source of $CO_2$ is available for use with the device. A minimum pressure of about 110 psi in $CO_2$ tank 318 is preferred for use with the present invention. Thus, pressure switch 210 may be set to actuate at about 85 psi, thereby signalling the CPU should the pressure in $CO_2$ tank 218 drop below that threshold pressure.

After pressure switch 210, the pressurized $CO_2$ supply line 320 is divided to thereby provide a supply of pressurized $CO_2$ to a variety of sources. One of the divisions of the line connects into $CO_2$ drive line 130 which connects into four-way valve 138 to drive the ram 124 of FIG. 5. Another division connects into $CO_2$ supply line 239 to drive the piston 228 to open the chamber door 230, as illustrated in FIG. 5. Finally, the remaining branch of the supply line 320 connects into the carbonator 312 where the $CO_2$ reacts with the water to form carbonated water.

Within the carbonator 312, a reservoir 322 of carbonated water is maintained. The present invention utilizes a novel recirculation tube 324 within the carbonator 314 through which carbonated water is removed from the bottom portion of the reservoir 322. A recirculation line 326 carries the recirculated water from the recirculation tube 324 through three-way valve 302 and back into the carbonator 312 as previously described. By recirculating the water within the reservoir 322 of the carbonator 312, the water is carbonated as closely as possible to its saturation point, thereby maximizing the quality of the beverage which is ultimately dispensed through the device.

An exit tube 330 is disposed within the carbonator 312 through which carbonated water may be removed from the bottom portion of the reservoir 322 through a carbonated water supply line 332. Thus, when dispensing a drink, the carbonated water component of the drink is supplied from the carbonator 312 through carbonated water supply line 332.

A conventional water-level detector (not shown) is employed within the carbonator to control the actuation of three-way valve 302 and thereby control the level of carbonated water in the reservoir 322 of the carbonator 312. When the level of reservoir 322 drops below a predetermined minimum level, the water level detector will send a signal to the CPU. In response, the CPU will actuate three-way valve 302 such that water from fresh water supply line 300 will pass through the valve 302 and into the carbonation recirculation system 304.

When the level of the reservoir 322 reaches a predetermined maximum level, the water-level detector will again signal the CPU of that condition. In response, the CPU will actuate three-way valve 302 to commence recirculation and shut off the flow of fresh water into the carbonation recirculation system 304.

Upon leaving the carbonator 312, the carbonated water passes through a post-carbonation cooling coil 334 which is also disposed in ice-water bath 310. Because ice-water bath 310 maintains a temperature approximately equal to the freezing point of water, the carbonated water will be cooled to approximately 33 to 34 degrees Fahrenheit.

From the ice-water bath 310, the carbonated water supply line 332 enters a manifold 336 where the supply line 332 is divided into multiple pump drive lines 340. Each drive line 340 is used to provide a driving fluid for driving a proportioning pump 342 utilized in proportioning the correct ratio of carbonated water and syrup flavoring for one of the beverages dispensed by the beverage dispensing apparatus, as more fully disclosed in U.S. Pat. No. 5,058,768 to Lichfield. By utilizing the proportioning pump of the Lichfield patent, the Brix of the dispensed beverage remains uniform and is not materially affected by any change in the dispensing conditions, such as the ambient temperature, the temperature of the syrup or the temperature of the carbonated water.

Thus, a proportioning pump 342 is provided for each flavor of beverage to be dispensed at each beverage dispensing station. In a presently preferred embodiment of the invention, four beverage dispensing stations 14 (FIG. 1) are included in each apparatus 10, with six flavors of beverages being dispensed at each station 14. Thus, a total of 24 proportioning pumps would be employed in such an embodiment.

The schematic of FIG. 8 illustrates an embodiment in which only one beverage dispensing station 14 is employed, with six flavors of beverages being dispensed. Thus, six pump drive lines 340 are illustrated as connected into manifold 336. Each drive line 340 would be connected into the drive fluid input 344 of its corresponding proportioning pump 342.

The syrup flavoring for use with the present invention preferably is packaged in bag-in-box containers 346. Typically, two bag-in-box containers will be employed for each flavor of syrup to be dispensed in the machine. A change-over valve 348, such as those conventionally known and used in the art, is utilized to direct the flow of syrup from the second bag-in-box container when the first is emptied. All bag-in-box containers 346 are preferably stored in the lower section 28 of the cabinet 24 (FIG. 1).

A syrup supply line 350 is provided from the change-over valve 348 and is connected into the syrup input 352 of the proportioning pump 342. As explained in the previously referenced Lichfield patent, the proportioning pump 342 will dispense predetermined rationed quantities of syrup and carbonated water through corresponding water and syrup exit ports, 354 and 356. Thus, a water line 358 is provided at the water exit port 354 of each proportioning pump 342.

In accordance with the present invention, the water line 358 from each proportioning pump 342 is connected to a post-pump water manifold 360 in which all of the water lines 358 are merged into carbonated water supply line 196 which leads into beverage dispensing nozzle 148. Prior to entering the beverage dispensing nozzle 148, however, the carbonated water supply line is passed through a post-pump cooling coil 362 in ice-water bath 310.

Because the beverage dispensing apparatus may sit idle for substantial periods of time without dispensing any beverage, the temperature of the carbonated water in the lines between the post-carbonation cooling coil 334 and the dispensing nozzle 148 could rise significantly. Thus, by circulating the carbonated water through the ice-water bath 310 prior to dispensing it through the beverage dispensing head 148, the carbonated water can again be cooled.

Importantly, the use of the post-pump water manifold 360 permits the carbonated water that is pumped through all six proportioning pumps 342 to be cooled with a single post-pump cooling coil 362. Thus, the cost of five cooling coils is eliminated. Additionally, the required size of ice-water bath 310 is reduced as it need only accommodate a single post-pump water cooling coil 362.

When dispensing a beverage through the beverage dispensing nozzle 148, a single proportioning pump 342 is operating and dispensing a precise volume of carbonated water. Because the carbonated water supply line 196 coming out of the post-pump manifold 360 is at all times filled with carbonated water, the precise proportions of carbonated water dispensed by the proportioning pump 342 are maintained across the post-pump manifold 360. Thus, even though all water lines 358 are merged into a single supply line 196, the proportioning function of the proportioning pumps 342 is not disrupted by the use of the post-pump manifold 360.

Because the syrup flavors obviously cannot be merged into a common line, a separate syrup input line 198 for each proportioning pump 342 is provided. To ensure that the beverage is dispensed at a consistent temperature, the syrup input lines 198 each pass through an individual post-pump cooling coil 364 prior to entering the head manifold 174.

From the foregoing, it can be seen that the present invention provides a beverage dispensing apparatus and process which may be used by a consumer to fill recyclable containers with beverages such as carbonated soft drinks and thereby provide a low-cost alternative to purchasing pre-packaged beverages. The apparatus of the present invention consistently dispenses a quality beverage, such as a beverage having a consistent Brix, having highly carbonated water and being dispensed at a consistently cold temperature.

Additionally, the present invention provides a beverage dispensing apparatus and process which is user friendly, and which does not rely on the user to determine when to shut off the flow of beverage to the container or to control foaming.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A process for filling a container with a foamable beverage, the beverage comprising a non-foamable component which includes a carbonated liquid and a foamable component, comprising the steps of:

positioning a beverage dispensing nozzle into fluid communication with an opening of the container;

directing a flow of the non-foamable component of the beverage through the nozzle and onto an interior sidewall of the container; and directing a flow of the foamable component of the beverage through the nozzle into the container and away from the flow of the non-foamable component of the beverage.

2. A process for filling a container as defined in claim 1, further comprising the step of initially sealingly engaging the nozzle and the container.

3. A process for filling a container as defined in claim 1, wherein the step of directing a flow of the non-foamable component of the beverage onto a interior sidewall of the container comprises directing a flow of the non-foamable component of the beverage through a first port of the beverage dispensing nozzle and the step of directing a flow of the foamable component of the beverage into the container comprises directing a flow of the foamable component of the beverage through a second port of the beverage dispensing nozzle.

4. A process for filling a container as defined in claim 3, further comprising the step of sealingly engaging the container and the beverage dispensing nozzle and removing from the container the fluid being displaced by the beverage entering the container through a relief port in the beverage dispensing nozzle.

5. A process for filling a container as defined in claim 1, further comprising the step of monitoring the fluid being displaced by the beverage entering the container for the presence of liquid and discontinuing the flow of beverage into the container after liquid has been detected in the flow of fluid being displaced by the beverage entering the container.

6. A process for filling a container as defined in claim 5, wherein the discontinuing step is followed by waiting a predetermined period of time and introduced additional beverage into the container.

7. A beverage dispensing nozzle for filling a container with a foamable beverage, the beverage comprising a non-foamable component which includes a carbonated liquid and a foamable component, comprising:

a body comprising:

a first port configured for directing a flow of the non-foamable component of the beverage onto a side wall of the container; and a second port through which a flow of the foamable component of the beverage may be directed into the container and away from the flow of the non-foamable component of the beverage.

8. A beverage dispensing nozzle for filling a container with a foamable beverage as defined in claim 7, wherein the first port comprises a cylindrically shaped channel extending concentrically about the second port.

9. A beverage dispensing nozzle for filling a container with a foamable beverage as defined in claim 8, wherein the first port further comprises an outlet orifice for directing the flow of the non-foamable beverage onto the side wall of the container.

10. A beverage dispensing nozzle for filling a container with a foamable beverage as defined in claim 7, further comprising a relief port through which the fluid being displaced by the beverage entering the container may exit the container, the relief port comprising a cylindrically shaped channel extending concentrically about the first port.

11. A beverage dispensing nozzle as defined in claim 7, further comprising a bottle seal configured such that the container and the body of the nozzle may be sealingly engaged.

12. A beverage dispensing nozzle as defined in claim 11, further comprising a rubber gasket extending radially about said body such that the container may be sealed about the beverage dispensing nozzle.

13. A beverage dispensing nozzle as defined in claim 7, wherein the body is configured to fit within the opening of the container.

14. A beverage dispensing nozzle as defined in claim 13, wherein the first port is at least partially defined by a substantially cylindrical tube positioned within the body, the cylindrical tube having an end which is flared axially outwardly to thereby direct the non-foamable component of the beverage onto the side wall of the container.

15. An apparatus for dispensing a foamable beverage into a container, the beverage comprising a non-foamable component which includes a carbonated liquid and a foamable component, comprising:

a dispensing line for introducing the beverage into the container, the dispensing line including a shutoff mechanism for discontinuing flow of the beverage through the dispensing line and a beverage dispensing nozzle through which beverage may be introduced into the container, the beverage dispensing nozzle comprising:

a first port configured for directing a flow of the non-foamable component of the beverage onto a side wall of the container; and a second port through which a flow of the foamable component of the beverage may be directed into the container and away from the flow of the non-foamable component of the beverage;

a shutoff mechanism for discontinuing flow of the beverage through the dispensing line;

a liquid detector in communication with the container, the liquid detector configured to monitor the flow of fluid which is displaced from the container as the beverage is introduced into the container through the dispensing line; and a shutoff actuator in communication with the liquid detector, the shutoff actuator configured to actuate the shutoff mechanism upon the detection of liquid by the liquid detector thereby discontinuing flow of the beverage through the dispensing line.

16. An apparatus as defined in claim 15, further comprising a bottle seal configured such that the container and the body of the nozzle may be sealingly engaged.

17. An apparatus as defined in claim 16, wherein the bottle seal comprises a rubber gasket extending about the body of the beverage dispensing nozzle.

18. An apparatus as defined in claim 15, further comprising a relief port through which the fluid being displaced by the beverage entering the container may exit the container, the relief port comprising a cylindrically shaped channel extending concentrically about the first port.

19. An apparatus as defined in claim 15, wherein the liquid detector comprises a pressure sensor.

20. An apparatus as defined in claim 19, further comprising a channel connecting the pressure sensor to the relief port of the beverage dispensing nozzle.

21. An apparatus as defined in claim 15, wherein the shutoff mechanism comprises an electrically actuated valve.

22. An apparatus as defined in claim 21, wherein the electrically actuated valve comprises a solenoid.

23. An apparatus as defined in claim 21, wherein the shutoff actuator comprises a computer in electrical communication with the electrically actuated valve and with the liquid detector.

24. An apparatus for dispensing a beverage into a container, comprising:

a beverage dispensing nozzle through which the beverage may be directed into the container;

an ultraviolet light positioned to expose the beverage dispensing nozzle at predetermined times to destroy bacteria which may be on the beverage dispensing nozzle; and an ultraviolet light detector positioned to detect when the ultraviolet light is emitting light.

25. An apparatus as defined in claim 24, further comprising a beverage dispensing chamber in which the beverage dispensing nozzle, the ultraviolet light and the ultraviolet light detector are positioned.

26. An apparatus as defined in claim 25, further comprising a sanitizing nozzle positioned within the beverage dispensing chamber, the sanitizing nozzle configured to permit a spray of hot water to be directed towards the beverage dispensing nozzle.

27. An apparatus as defined in claim 25, further comprising a plurality of sanitizing nozzles positioned within the beverage dispensing chamber, the sanitizing nozzles being in fluid communications with a supply of hot water and configured to permit a substantially omni-directional spray of hot water to be directed within the chamber.

28. An apparatus as defined in claim 25, wherein the beverage dispensing chamber is substantially enclosed and wherein the beverage dispensing chamber includes an opening through which the container may be retracted into the chamber and a chamber door configured to cover the openings.

29. An apparatus as defined in claim 28, further comprising a pressure sensor positioned about the opening of the beverage dispensing chamber, the pressure sensor configured to detect whether a foreign article is interfering with the retraction of the container into the beverage dispensing chamber.

30. An apparatus as defined in claim 28, further comprising a yoke configured in a U shape such that the neck of a container may rest on the yoke and be supported by the yoke, the yoke mounted for retractable movement such that the container may be retracted by the yoke into sealing engagement with the beverage dispensing nozzle.

31. An apparatus as defined in claim 30, further comprising an infrared light emitter and an infrared light detector, the infrared light emitter and the infrared light detector positioned on the yoke such that an infrared beam of light emitted by the infrared light emitter may be detected by the infrared light detector and such that the infrared beam of light emitted by the infrared light emitter will intersect any container being supported by the yoke, the apparatus further comprising means for measuring the attenuation of the beam of infrared light emitted by the infrared light emitter.

* * * * *